US009685060B2

(12) United States Patent
Mantsvetov

(10) Patent No.: US 9,685,060 B2
(45) Date of Patent: Jun. 20, 2017

(54) METHOD OF WARNING IN HUNTING AND ROAD TRAFFIC AND BASED ON IT APPARATUS FOR PERSONAL SAFETY AND PROTECTION

(71) Applicant: Alexandre Mantsvetov, Burlington (CA)

(72) Inventor: Alexandre Mantsvetov, Burlington (CA)

( * ) Notice: Subject to any disclaimer, the term of this patent is extended or adjusted under 35 U.S.C. 154(b) by 0 days.

(21) Appl. No.: 14/243,865

(22) Filed: Apr. 2, 2014

(65) Prior Publication Data

US 2015/0287312 A1 Oct. 8, 2015

Related U.S. Application Data

(60) Provisional application No. 61/807,637, filed on Apr. 2, 2013.

(51) Int. Cl.

| | |
|---|---|
| ***G08B 21/02*** | (2006.01) |
| ***G08G 1/16*** | (2006.01) |
| ***G08G 1/005*** | (2006.01) |

(52) U.S. Cl.

CPC ..... *G08B 21/02* (2013.01); *G08B 21/0269* (2013.01); *G08B 21/0277* (2013.01); *G08G 1/005* (2013.01); *G08G 1/166* (2013.01)

(58) Field of Classification Search

CPC ..... G08B 21/02; G08B 21/0205; G08B 21/0263; G08B 21/0266; G08B 21/0269

See application file for complete search history.

(56) References Cited

U.S. PATENT DOCUMENTS

| | | | | |
|---|---|---|---|---|
| 7,322,443 | B1 * | 1/2008 | Rizza | 182/187 |
| 2007/0241913 | A1 * | 10/2007 | Langenfeld | A01M 31/00 340/573.2 |
| 2014/0190051 | A1 * | 7/2014 | Wichner | F41A 17/12 42/1.05 |
| 2014/0311828 | A1 * | 10/2014 | Bassett et al. | 182/124 |

* cited by examiner

*Primary Examiner* — Andrew Bee

(57) ABSTRACT

The method of warning in the sport of shooting and hunting and road traffic, and based on it apparatus for personal safety and protection are provided. The method is based on analyzing the coordinates of the devices, which are exchanging this information by direct radio communication in real time using a suitable for the chosen application radio frequency. The apparatus is based on RF communication technology and, as an additional feature, digital photo and video technology, and the methods of this technology utilization for efficiency and convenience for users.

6 Claims, 20 Drawing Sheets

METHOD OF WARNING IN HUNTING AND ROAD TRAFFIC AND BASED ON IT APPARATUS FOR PERSONAL SAFETY AND PROTECTION

CROSS-REFERENCE TO RELATED APPLICATIONS

This application claims the benefit of U.S. Provisional Patent Application Ser. No. 61/807,637 filed Apr. 2, 2013; the disclosure of which is incorporated herein by reference in its entirety. It is assigned to Protective Arms Systems Inc. Canada.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates generally to systems preventing hunting and/or shooting accidents by alerting the shooter about unsafe shooting in the zone of shooting, which use automatically emitting RF signals containing geographical coordinates and the receiver of said signals.

The necessity of the embodiments of the present invention related to the sport of hunting and shooting is confirmed by the available statistics on hunting accidents as a result of target misidentification. There are about 1-2 hunting accidents per day in the USA. The details can be found in the documents of the International Hunter Education Association IHEA-USA. http://ihea-usa.org/news-and-events/news/incident-reports.

In addition, the inventor found and studied newspapers' reports and documentary videos. For imagining it, it is enough just to read the headlines:

6 Hunters Hit By Shotgun Blasts; Arrest Warrant Issued In Fatal Hunting "Accident"; At War Front Man Injured In Hunting Accident; Boy Charged In Fatal Hunting Accident; Boy shot in Orange Co. hunting accident; Calgary man shot to death in hunting accident; Cow shot to death may have been mistaken for deer; Dog shot by hunter; Duncannon man charged with accidentally shooting friend while hunting; Elk River man shot by brother in holiday grouse hunting accident; Fatal shooting of Louisa Co. hunter ruled accident; Fort Riley Soldier Shot In Hunting Accident; Friends mourn man killed in hunting accident; Genesee Co. man charged with hunter-related shooting; Hunter Accidentally Shoots Man, 13-Year-Old Boy; Hunter apparently commits suicide after shooting companion to death; Hunter hysterical after shooting husband; Hunting accident bonds 5 classmates from Kennewick; Hunting accident haunts Falmouth man and his buddies; Hunting Accident Leaves One Man Dead; Hunting accidents kill 1, injure 1 in Nunavut; Italian hunting in the dock after 35 people killed in four months; Local teen killed in hunting accident; Man and dog shot by hunter at Guana River Wildlife Management; Man dies in Shoshone County hunting accident; Man killed in hunting accident; Man stable after hunting accident; Missing police dog killed by hunter; Montmartre man, 32, accidentally shot by hunter;

One man dead after Rusk County hunting accident; Police Identify Boy Killed in Nelson Co. Hunting Accident; Sterling man hit with buckshot on Rail Trail in Holden, shooter not located; Teenage shooting victim, uncle 'peas in a pod'; Dad Accidentally Kills Son After Mistaking Him For A Turkey; Mother And Daughter Hurt In Deer Hunting Accident; Two Brothers Shot In Hunting Accident; Man shot while jogging in Holden, Mass.; etc.

The same method and technology used for preventing shooting accidents in the sport of hunting and shooting as another embodiment of the present invention is intended for equipping ordinary vehicles with an alert visible light and/or vibrating signal in front of the driver's face, which will be automatically activated if behind said ordinary vehicle in the preset distance will appear a first responder's vehicle with activated alarm signals.

The necessity of this embodiment of the invention is related to safety on the road while moving the first responders' vehicles in traffic with activated alarm signals, and is confirmed by the FBI Law Enforcement Bulletin Report of March 2011. Roadside Visibility Issues:

"The Human Toll Preliminary data for 2009 from the National Law Enforcement Officers Memorial Fund showed that for the 12th year in a row, more officers were killed in the line of duty in traffic incidents than from any other cause of death, including shootings. According to a U.S. Fire Administration study for 2008, 28 out of the 118 firefighters who died while on duty were killed in vehicle crashes. Another 5 were struck and killed by vehicles. These sobering statistics clearly demonstrate the need to protect law enforcement officers, firefighters, and other first responders as they perform their duties on the nation's streets and highways.

Perhaps one of the most essential parts of the equation is the alertness of civilian drivers and their ability to recognize an emergency vehicle and take suitable action.

To read the complete report (NCJ 229885), access the National Criminal Justice Reference Service's Web site, http://www.ncjrs.gov."

Inventor is not intended to collect the statistical data and specific number of accidents and victims in this document. A person with ordinary skills can figure out how many people pass away in the ambulances staying in traffic, how many people lose their lives in the fire or as victims of criminal activities because the first responders cannot come in time. The necessity of the present invention is obvious.

SUMMARY OF THE INVENTION

The purpose of the present invention is the creation and continuation of the development of the product lines based on the same method and using the same technology. For convenience of the embodiments of the present invention product understanding the inventor is using the following short code names and explanation for the products:

U-Minder—The apparatus, universal multifunctional assisting electronic device for outdoor activities developed for professional and advanced hobbyists equipped with all features usually required in outdoor activities including automatic alert safety feature intended to prevent shooting accidents in the sport of hunting and shooting by alerting a shooter about unsafe shooting due to presence of humans or hunting dogs, or other protected objects in the zone of shooting by alarm signals.

B-Minder—the simplified safety unit made for broadcasting its coordinates for the purpose to identify their carriers (passers-by, hunting dogs, etc.) as protected objects and inform about their locations for preventing shooting accidents in the zone of the sport activity of shooting and hunting.

T-Minder—The adapter and durable protective enclosure and holder with additional compartment for external cell phone equipment such as optical zoom, equipped with solar cell charging system, additional power battery, modulator RF frequency, additional antenna amplifier for the smart cell phone made for converting an ordinary smart cell phone into universal assisting electronic device with automatic alert safety feature intended for outdoor activities and for preventing shooting accidents in the sport of hunting and shooting by alerting a shooter about unsafe shooting due to presence of humans or hunting dogs, or other protected objects in the zone of shooting by alarm signals.

S-Minder—The apps (software) which makes the ordinary smart cell phone in addition to its ordinary features to operate as a beaconing safety device is intended to prevent shooting accidents in the sport of hunting and shooting by alerting a shooter about unsafe shooting due to the presence of said smart phone in the zone of shooting by an alarm signal.

V-Minder—The radio electronic system works similar to the apparatus warning feature but installed in ordinary vehicles and first responders' vehicles and is intended for warning a driver of an ordinary vehicle by a light and/or vibration signal located in front of the driver or activating an automatic driverless vehicle's robotic system of the necessity to clear the way for first responders' vehicles with activated warning signals.

L-Minder—The radio electronic system works similar to the apparatus warning feature but is installed in traffic lights and first responders' vehicles and is intended for automatic switching the color of said traffic lights to green for clearing the way for the first responders' vehicles approaching said traffic lights with activated warning signals.

The method of alerting on the unsafe shooting in the sport of hunting and shooting by firearm, bow and crossbow is one of the embodiments of the present invention.

Said method allows the safety device operating independently from a weapon, is not attached to a weapon and it does not use a weapon as a holder or carrier. The type of arms, which a shooter is using doesn't matter. The safety alert function can operate with or without shooting a weapon and can be used by hunters, fishermen, tourists, and anybody else.

Advantage of the invention is that it automatically informs a shooter if a shooting zone is unsafe for shooting and a weapon's projectile can accidently reach and hit a human or other protected object as a result of shooter's target misidentification due to bad visibility (poor light, bushes, etc.), or as a stray bullet, or as a result of hunter's nervous excitement during swinging gun on game.

Advantage of the invention is that it proposes the method and technical solution for safe zone checking, which allows using the range of radio frequency, which has relatively good penetration through obstacles such as trees, bushes, etc. and provides a stable RF signal at the range over 1 km with the absence of parasitical signal's effects such as signal reflection or directed antennas' side lobs effects, etc.

Advantage of the invention is that this feature could be built in traditionally used existing devices such as GPS for walkers, walkie-talkie, etc. Finally could be designed in one miniature body a universal multifunctional apparatus containing all necessary features and functions such as photo and video cameras, ordinary radio, cell phone etc., required by any category of outdoor enthusiasts, as well as a safety feature.

The apparatus developed for a shooter will inform if the zone of shooting is not safe for shooting, meaning that human or other protected by the present invention objects are present in the zone (sector) of shooting.

Advantage of the invention is the method which the apparatus uses for warning its user about unsafe shooting, the mounting/location and the ability to operate automatically, hands free and simultaneously to be in automatically battery charging position/mode while staying in alert protection and beaconing mode for long time use without external power source.

The method of ensuring safe passing conditions for first responders' vehicles through the road traffic is another embodiment of the present invention.

Advantage of this embodiment of the invention is the opportunity to inform the driver of the ordinary vehicle about the necessity to clear the way for the first responders' vehicles moving in the same direction with activated alarm signals behind the ordinary vehicle or crossing an intersection ahead of the ordinary vehicle even when the driver of ordinary vehicle cannot see and hear the alert signals in his vehicle's windows or rear view mirrors, because the first responders' vehicle is too far away, or the view and visibility are closed by an obstacle (large truck, etc.) and/or driver of ordinary vehicle has switched on loud music, radio, etc.

Further aspects of the invention will become apparent from consideration of the drawings and the ensuing description of the embodiments of the present invention. A person skilled in the art will realize that other embodiments of the invention are possible and that the details of the invention can be modified in a number of respects, all without departing from the inventive concept. Thus, the following drawings and description are to be regarded as illustrative in nature and not restrictive.

LEGEND OF NUMBERING ON FIGURES

Figure 1:
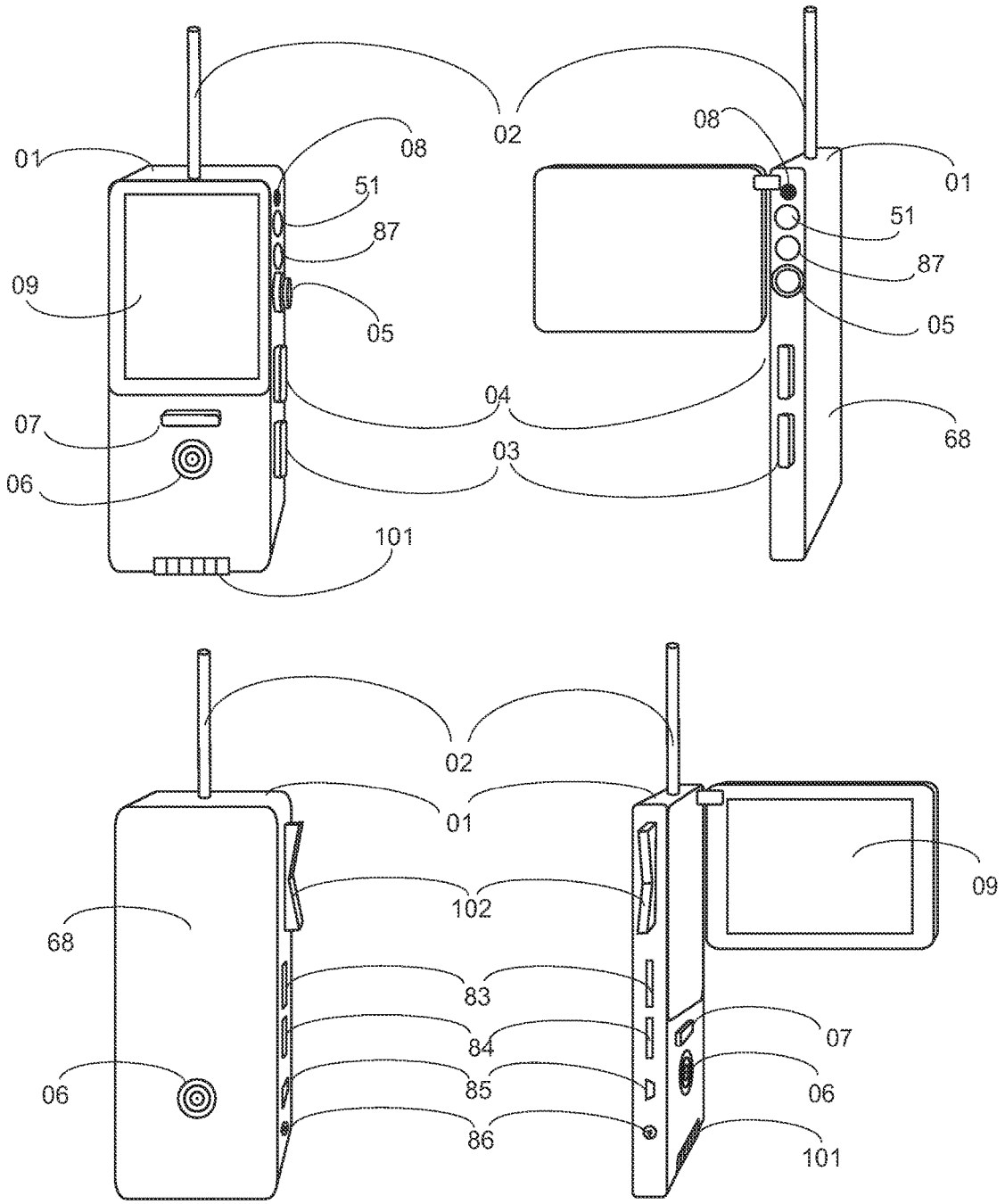
FIG. 001 is front, back and side views of the main apparatus with switches, buttons and other equipment.

01—Apparatus (U-Minder)
02—antenna for two-way radio of the apparatus
03—speak/listen button
04—multifunctional programmable button
05—camera lens/optical zoom
06—speaker
07—main ON/OFF power switch
08—microphone
09—flip-out articulating touch screen, command and GPS display monitor.
10—function (mode) "alert on unsafe shooting"
11—function (mode) "GPS unit with monitor"
12—function (mode) "beacon"
13—function (mode) "walkie-talkie"
14—optional feature (mode) "Video Camera"
15—optional feature (mode) "Photo Camera"
16—optional feature (mode) "Cell Phone"
17—optional feature (mode) "Photo Flash"
18—optional feature (mode) "Flashlight/videolight"
19—optional feature (mode) "Time stamp recorder"
20—equipment "Solar charging system"
21—equipment "Power Supply" (rechargeable battery with indicator)
22—equipment "Signal processing system" (a signal processing system is a device that processes input signals and/or produces output signals)
23—equipment "Accelerometer with gravity and gyroscope sensors"
24—equipment "Accelerometer with magnetometer" (digital compass)
25—equipment "GPS receiver for receiving GPS signal and calculating coordinates"

26—equipment "RF modulator with antenna amplifier"
27—equipment "Walkie-talkie" (two-way radio)
28—main functions (modes) of the apparatus
29—optional features (modes) of the apparatus
30—main equipment of the apparatus required for main functions (modes) operation
31—additional optional device unit
32—external RF antenna of additional optional device unit
33—main functions (modes) of the additional device unit
34—main equipment of the additional device unit
35—equipment supporting beacon function
36—optional feature "Google glasses" and similar devices
37—hunter equipped with the apparatus
38—passer-by equipped with optional additional unit 31
39—hunting dog equipped with optional additional unit 31
40—direction of "swinging on game"
41—safe shooting zone (sector) with the preset angle between two radii
42—passers-by or hunters equipped with the apparatus or additional unit 31
43—preset range of the apparatus alert mode operation (related to U-Minder or/and V-Minder)
44—rotation of the apparatus around its vertical axis
45—rotation of the apparatus around its horizontal axis
46—tourist tent with the apparatus 01 inside
47—external apparatus' enclosure/holder
48—hinge joint antenna holder
49—antenna's folding (bending) direction
50—inability of antenna movement around vertical axis
51—photo flash opening
52—optional feature (mode) "Clock/timer/calendar"
53—supporting hard plastic stick attached to the external device enclosure/holder 47
54—supporting leather, rubber or fabric holder strap designed to keep enclosure/holder 47 moving along with an arm
55—solar cells panel/epaulet
56—ordinary radio for listening to weather warnings or other news
57—equipment similar to Bluetooth. Short range radio transceiver allows using wireless external devices
58—equipment Vibrator (vibrational alert signal)
59—equipment Light alert signal
60—activation button for wireless external remote-control
61—Wireless external remote-control (with system activation button and alert signals)
62—Optional mounting belt/strap fastener
63—Test System Button, a pushbutton intended for system functionality self-testing
64—Mirror Cap intended to redirect the light alert signal towards hunter's eyes
65—Opening/hood for Light Signal, can be covered from dust and water by protective transparent cover or cap
66—Mirror
67—Light Signal Beam
68—back side of the apparatus
69—epaulet apparatus holder and battery solar charging system with supporting equipment
70—support for external device's enclosure/holder and optional antenna compartment
71—the apparatus user location on the GPS map
72—the road
73—ambulance vehicle with activated alarm signal
74—police vehicle with activated alarm signal
75—ordinary vehicle
76—traffic direction
77—fishing house with the optional unit 31
78—preset alert signal reception range
79—preset zone of alert signal reception behind the vehicle
80—optional location of light signal around rearview mirror
81—optional location of light signal around GPS monitor
82—optional location of light and/or vibration signal around steering wheel
83—media card slot for recording video and photo files
84—cell phone SIM card slot using. The SIM card from the cell phone can be loaded into the apparatus which will make it possible to operate apparatus as an ordinary cell phone
85—universal USB port
86—power port
87—flashlight/video light
88—vehicle moving direction
89—direction of shooting
90—electronic equipment determining the safety zone for shooting and monitoring zone behind the vehicle and in front of it
91—rotation of electronic equipment 90 determining the safety zone for shooting and monitoring zone behind the vehicle around its vertical axis
92—livestock with the optional unit 31
93—additional external RF antenna
94—compartment for smart cell phone
95—protective cap for smart cell phone compartment
96—filler, foam or other material
97—smart cell phone
98—additional power battery, and circuit board for converting smart cell phone into the universal assisting device's activities with functions similar to the apparatus 01 (U-Minder)
99—cable with plug for connecting smart cell phone with transformer-adapter T-Minder
100—compartment for optical zoom and/or other additional supporting equipment which allows to provide the smart phone with the features similar to the apparatus 01
101—electrical connector for connecting the apparatus 01 to the solar cell epaulet by the holder/enclosure
102—Key button for optical zoom operating
103—preset monitoring zone in front of the ordinary vehicle
104—first responder A
105—first responder B
106—first responder C
107—first responder D
108—intersection
109—building
110—the zone monitoring by the traffic lights
111—location of the traffic lights
112—red light
113—green light

DETAILED DESCRIPTION OF THE INVENTION

Key Terms

Zone of shooting—is the determined sector of preset circle and space between two radii with preset angle between them and the arc. In the present invention this term is related to the sport of shooting and hunting.

Zone of monitoring—is the determined rectangle behind the ordinary vehicle with the preset width close to the road's width and the length about 1 km, or in accordance with the regulations of Ministry of Transportation intended for clearing the way for the first responders' vehicles moving with activated alarm signals behind the ordinary vehicle. In the present invention this term is related to vehicles and road.

Mode—preset or switchable function of the devices.

Figure 2:
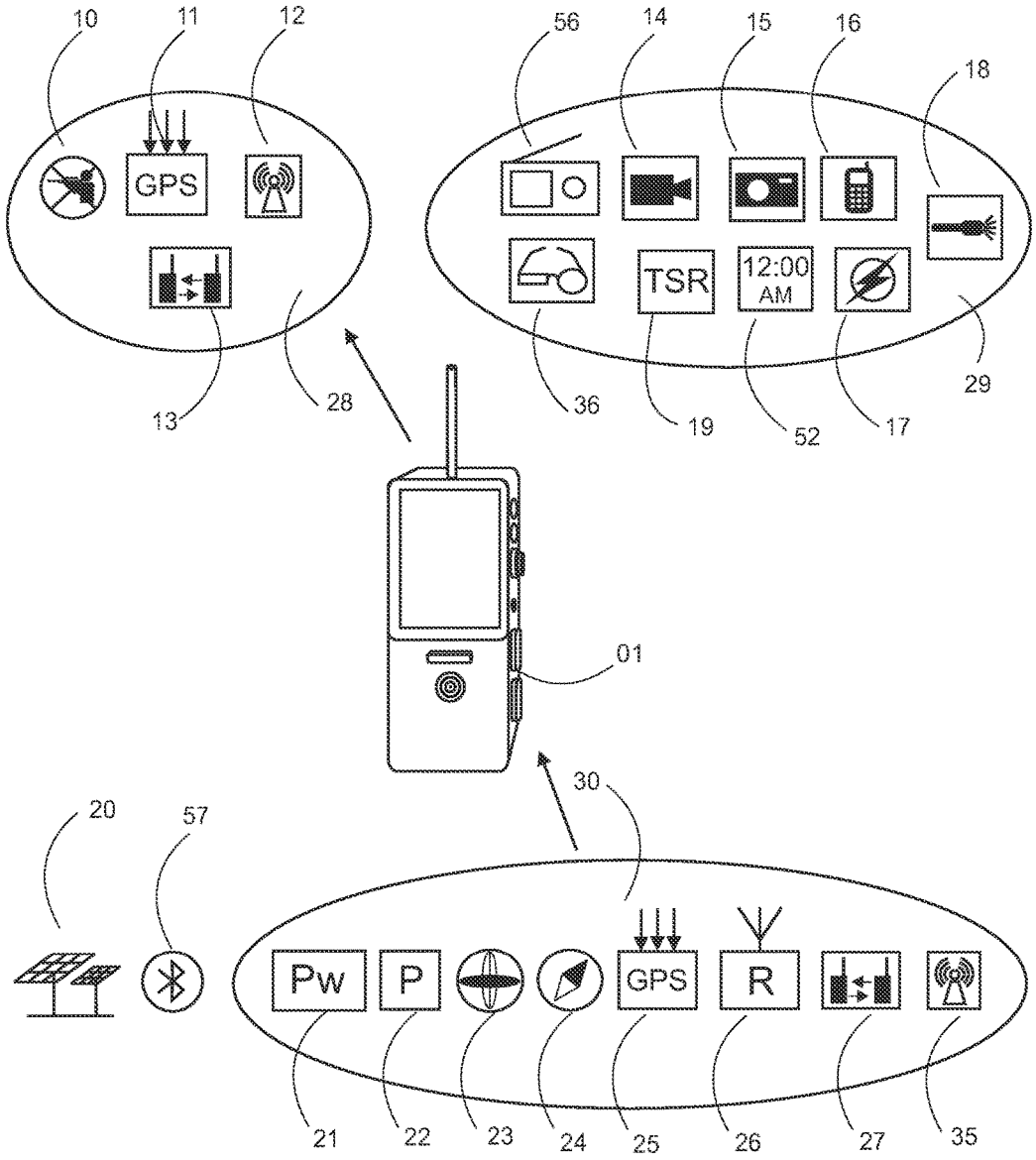
FIG. 002 Depicts the apparatus function features and equipment.

The present detailed description is intended for the invention's main functions 28 FIG. 002. The optional features 29 will be mentioned briefly for general explanatory purposes only.

Figure 5:
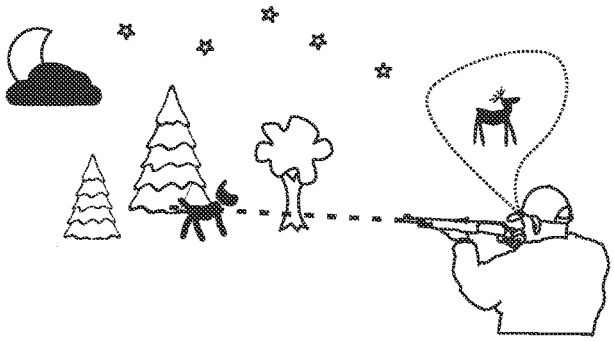
FIG. 005 Depicts the typical hunting accident situation-1 "Target Misidentification", the accident resulting from target misidentification when a shooter for some reason does not positively identify a target and mistakes it for game. In the diagram a hunter is targeting at his own dog thinking that it is a deer. It could be bad visibility or nervous excitement felt by a hunter at the first sight of game.
Figure 6:
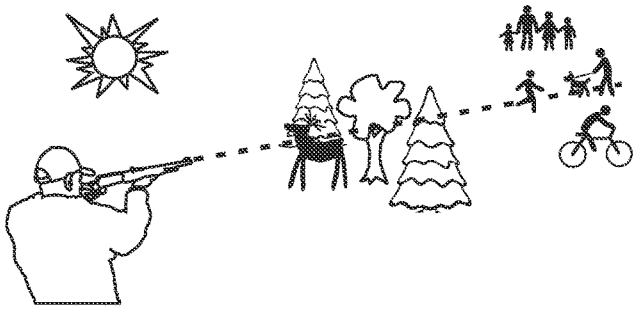
FIG. 006 Depicts the typical hunting accident situation-2 "Stray Bullet", which occurs when a fired crossbow arrow or a rifle bullet flying in the bushes far from a target, hits another hunter or passer-by. In the diagram a hunter is shooting at a deer. Visibility is good and the hunter believes that his shot is safe but he cannot see that there are people behind the trees.
Figure 7:
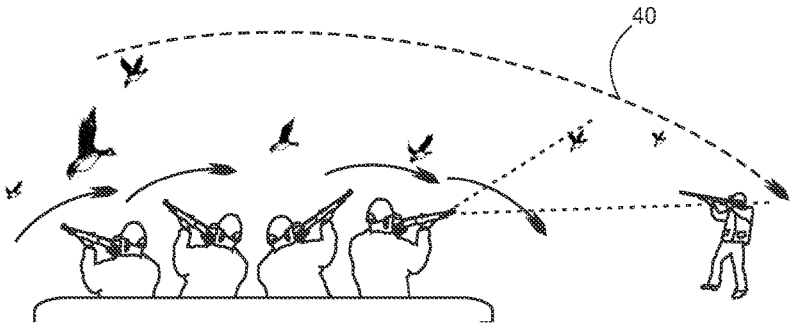
FIG. 007 Depicts the typical Situation-3 "Swinging on game", which happens when a hunter is moving his gun around and out of the border of the safe sector of shooting. The hunter's mind and his eyes are concentrated on a target, for example a flying bird. His nervous excitement does not allow figuring out before shooting that in his sight line is another hunter. In the diagram is shown a movement of a gun following birds towards a nearby hunter and how accidents can happen.

The statistics and based it on lessons on safe shooting used for shooters training and instructions teach that all shooting accidents happen in three typical situations depicted on FIG. 005; FIG. 006; FIG. 007 (see the drawings description). The method and apparatus of the present invention intends to solve this problem or to decrease statistics of shooting accidents. Additional benefits for users are that all features of this device are intended for saving their lives in critical situations and simultaneously to be convenient and practical for geologists, researchers of environment, other outdoor workers and enthusiasts. It is also useful for entertainment purposes in tourism, sports of fishing and hunting. The combination of several devices in one universal apparatus proposed in the present invention is saving space and decreasing the weight of luggage, which is usually carried for the activities mentioned above. The special mounting system and location of the apparatus not only make the users' hands free for any activities, but is also charging the battery of the apparatus during its use. So, the apparatus 01 FIG. 001 is promising to be a favorite tool for many people. The apparatus 01, FIG. 001 operation and the reason for the invention is explained in the fictional story below.

"George invites Bill to go hunting together. Bill calls his nephew Paul to come with them. Paul says that he'd go, if Daisy, Bill's dog, could also come.

When they get to the woods Paul decides to find a tall tree to climb and look around. Bill lies down to have a rest. Daisy chases a fox.

George hides behind some bushes. Finally George sees a deer and takes aim. However, his new electronic universal assisting device for outdoor activities made for personal safety and protection named U-Minder warns him that shooting in that direction is not safe. George doesn't know that a hiker is walking behind the trees. George gets lucky. As he turns in the opposite direction he sees another deer. But his U-Minder warns him again that shooting in that direction is not safe. George looks closely and realizes that he mistakes Daisy for a deer. George is disappointed, and decides to go to the lake and tries to shoot ducks. He is swinging his gun from side to side trying to target the flying ducks and is getting ready to shoot. But his U-Minder warns him again that shooting is not safe. George doesn't see that Bill comes from the side to the lake because he also wants to hunt for ducks.

Using their U-Minders as a Walkie-Talkie, they call Paul to tell him that they should go home for supper. Paul does not reply . . . Bill and George call Paul again and again, he does not respond. Then George gets an idea! They could use the U-Minder as a GPS tracker to locate Paul. This works, as they are able to locate him.

This is Paul's story. As planned, he walks around and finds a good tree to climb up. Paul sees a group of animals. Instead of shooting at them he uses his U-Minder as a photo camera. Tomorrow Paul will show his beautiful photographs to his mother and his girlfriend. When Paul is climbing down the tree he steps on a dead branch that breaks and he fells to the ground. Paul loses consciousness and also injures his leg. His U-Minder in its standby mode automatically broadcasts his GPS coordinates.

When George and Bill find Paul they don't know what to do, because they don't want to move him. Bill recalls how before their trip Paul loaded the SIM card from his new expensive smart phone into his durable U-Minder. Paul knows that a cell phone is useless in some remote areas. There is no reason to take an expensive delicate device, which cannot protect you in the woods where it might be broken or lost. It also requires one extra pocket to carry it in. The durable multipurpose U-Minder made for outdoor use is the solution for this.

Using the U-Minder as a GPS navigator George goes to find a place in the woods where the cell phone will work, so he can call for help. Bill stays with Paul. He listens to the weather network, over the U-Minder's FM/AM radio, because the weather has changed for the worse. Finally George reaches the highway and calls 911 and gives them Bill's U-Minder GPS coordinates.

The U-Minder accessories are: Automatic unsafe shooting alerting, Walkie-Talkie, GPS Navigator and tracker, Radio beacon, FM/AM radio, Video Camera, Photo Camera, Cell Phone Flashlight, Clock and calendar, Optional external Bluetooth accessories like Google glasses or U-Minder's remote control with optical alert signal and more. The U-Minder, universal assisting device for outdoor activities, will serve your personal safety and protection.

Apparatus and its Additional Optional Units

Apparatus

The apparatus 01 FIG. 001 is the fully functional system intended for personal protection and ensuring safety for its user, which contains all necessary equipment, functions and features for independent operations with many built-in modes and capable to coexist and wirelessly cooperate with other similar devices for providing main safety features and additional services by automatic alert signals, locations determination, voice and video communication between users, memorizing images of objects and events, etc.

Main functions and idea of the device 28 FIG. 002 are intended to protect its users from accidents by:

preventing shooting accidents as depicted on FIG. 005, FIG. 006, FIG. 007 (see the drawings description)

allowing user determining his own location using GPS/GLONASS mode 11 and preventing being lost in the woods or in an unfamiliar territory allowing user communicating with other users by voice in case they need help allowing user determining other users' location by determination of their beacon location in case a person is unconscious and cannot answer.

Some of additional optional features 29 FIG. 002 are also intended for safety:

ordinary radio 56 allows a user to hear weather warnings, information about searching for missing persons, or other local warning news, etc.

the time stamp recorder 19 for time and location of the apparatus use could keep the apparatus records of its use in case further investigation will be necessary (professional work of guards, forest rangers etc.)

photo and video cameras modes 14,15 could be used for witnesses' documentary records, etc. as well as for entertainment purposes.

For main functions 28 FIG. 002 the apparatus 01 FIG. 001 must be equipped with electronic equipment, signal processing system with updatable firmware 30:

the touch screen monitor 09 is intended to visualize GPS map and signals, work as a viewfinder for video and photo cameras mode and touch commands for switching optional features 29 FIG. 002 the speaker 06 and microphone 08, FIG. 001, which are intended to provide a voice conversation in the walkie-talkie mode, sound record in the video camera mode, for sound alert signals the camera lens 05 FIG. 001 is intended for providing photo and video optional features. It is obvious that the lens with suitable for the apparatus dimensions could be over a 20X optical zoom and in combination with high resolution image sensor the apparatus becomes a high quality photo and video camera usually appreciated by all outdoor enthusiasts the key button 102 FIG. 001 allows to operate the optical zoom lens 05 FIG. 001 the flashlight 87 and photo flash 51 FIG. 001 provide optional but very useful features 17 and 18 FIG. 002, which allow using photo and video features for short distance in insufficient light condition. It is also a flashlight, which could be a useful safety feature.

the ON/OFF power switch button 07 FIG. 001 is intended for switching apparatus on and off the press speak/listen button 03 FIG. 001 is designed for operation in walkie-talkie mode the programmable press button 04 FIG. 001 is intended for use for different operations such as video or photo camera, or flashlight, etc.

Figure 19:
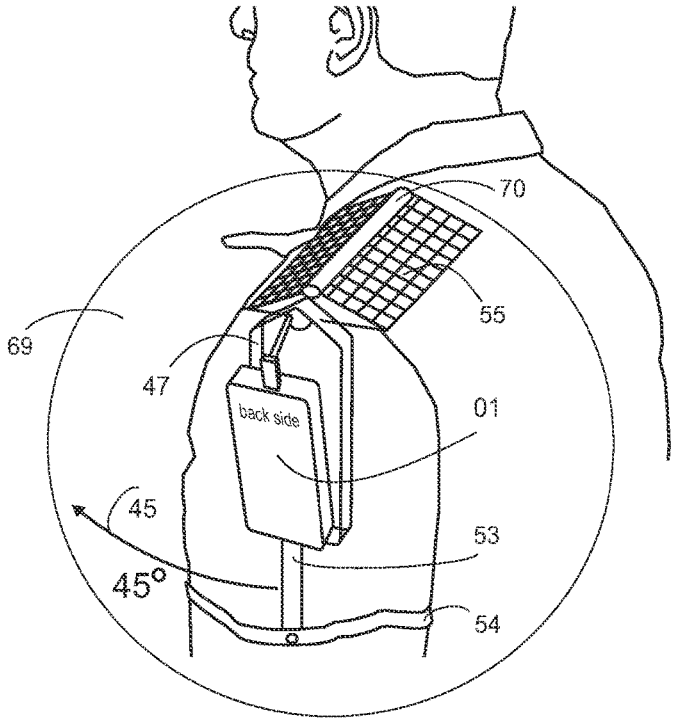
FIG. 019 Depicts the apparatus locating and fixation for targeting direction, and for operating in stand-by, beaconing, triggering, alerting, and battery charging, flashlight and camera modes and related to this equipment.

The additional optional solar cells epaulet (shoulder strap) battery charging system 69, FIG. 019 comprises the solar cells shoulder strap and a support/holder 55, FIG. 019

Figure 15:
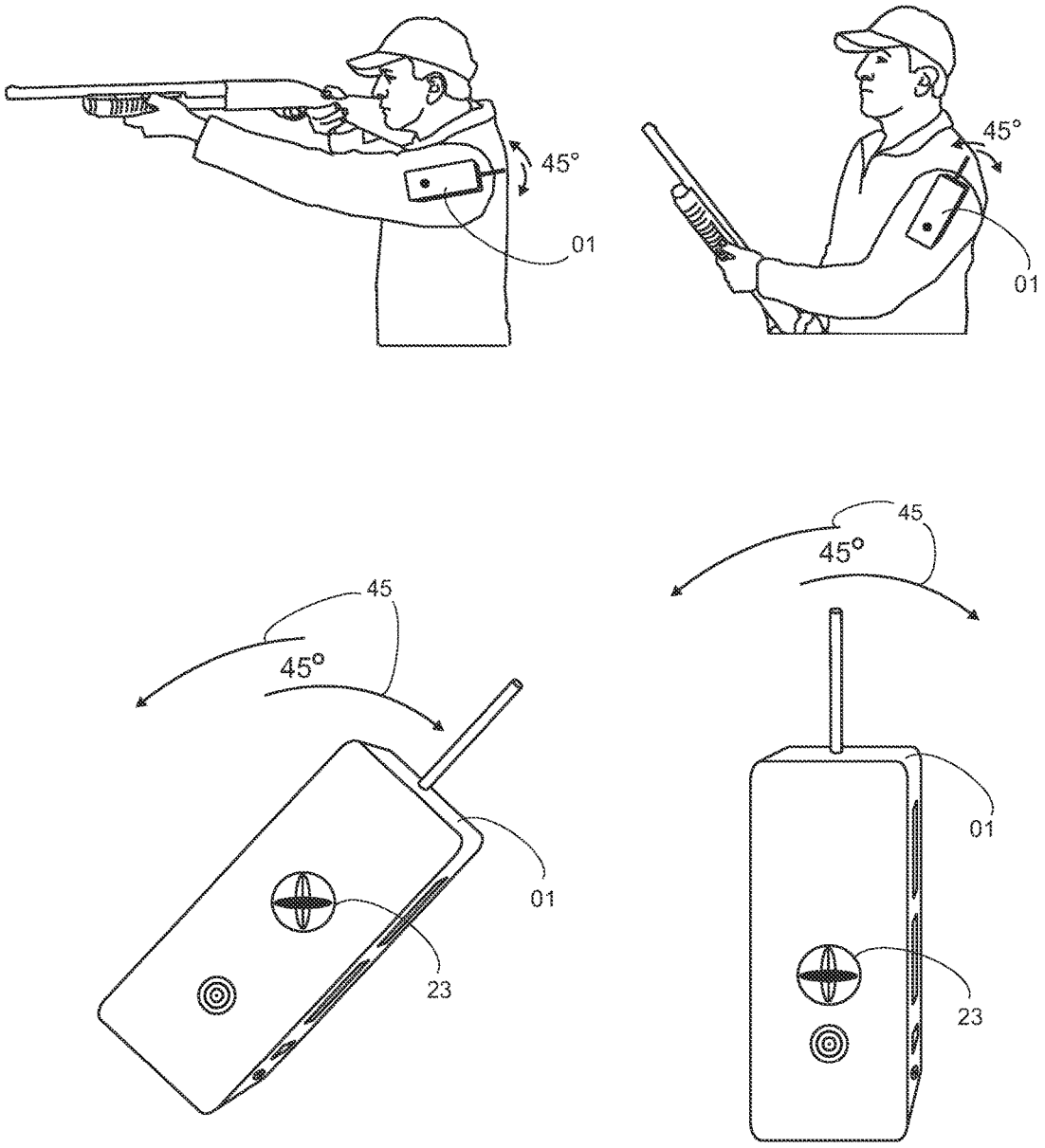
FIG. 015 Depicts the method and procedure of the apparatus automatic triggering for checking of the shooting zone prior to shooting.
Figure 20:
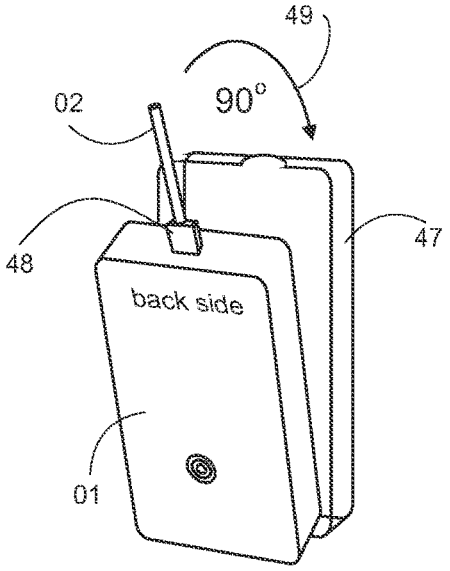
FIG. 020 Depicts the optional method of the apparatus body protection and for apparatus fixation.
Figure 21:
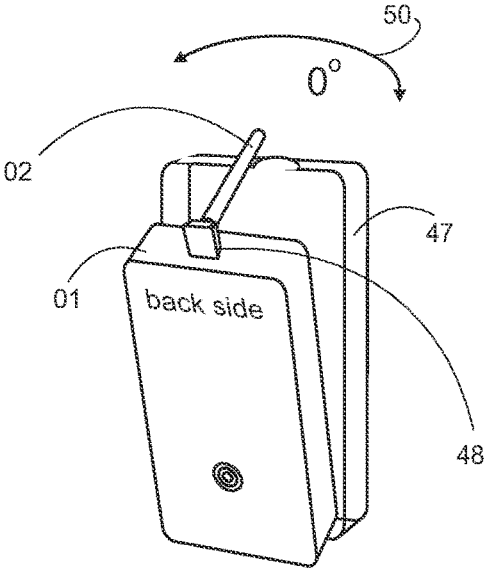
FIG. 021 Depicts the optional method of the external RF antenna folding and using it for the apparatus fixation for targeting direction.

The antenna compartment 70, FIG. 019 is an optional solution at the product designer's discretion The enclosure/holder 47, FIG. 019, FIG. 020, FIG. 021 is intended for the apparatus protection and holding it in proper position for operation and battery charging The supporting stick 53, FIG. 019 attached to the enclosure/holder 47, the supporting leather, rubber or fabric holder strap 54 designed to keep the enclosure/holder 47 moving along with the user's arm. It can be designed differently if required so it will provide the main purpose of this unit which is:

to hold the apparatus 01, FIG. 001 in vertical position and rotate it around horizontal axis only along with the user's arm and keeping it with an opportunity to rotate the apparatus around the vertical axis only along with the apparatus user's body. FIG. 015 depicts the motion of the apparatus in operation.

FIG. 019 depicts the idea of the design of the epaulet (shoulder strap) support/holder 69.

The holder/enclosure 47 FIG. 019 is hung by its top part to the solar epaulet (shoulder strap) 55 FIG. 019 and freely swings rotating around the horizontal axis, however, not allowing to rotate around vertical axis. This mechanism could be designed differently and it is a matter of the product design for the convenience of users. For example, the supporting hard plastic stick 53 attached to the external enclosure/holder 47 FIG. 019 and the supporting leather, rubber or fabric holder strap 54 FIG. 019 will provide the device movement along with the user's arm as shown on FIG. 015.

using the epaulet (shoulder strap) 55 FIG. 019 as solar cells system for apparatus's 01 FIG. 001 battery charging using the energy of light allows increasing system's operational time. It is important in case of long term expedition/trips in the area where the external power supply is unavailable. In case of an accident wherein the user is immobilized, the solar cells epaulet battery charging system 55 FIG. 019 can save the user's life because it allows the apparatus in standby beacon mode 12 FIG. 002 to work for an unlimited time. The holder/enclosure 47 FIG. 019, FIG. 020, FIG. 021 is protecting the apparatus from potential mechanical damage, water and dirt. For the user's convenience the antenna 02 can be folded and hidden in the special enclosure 70 FIG. 019.

The apparatus 01 FIG. 001 (U-Minder) can be used without the optional solar cells epaulet battery charging system and support/holder 55 and holder/enclosure 47 FIG. 020. However, it must be located as depicted on FIG. 19 and holds the apparatus 01 in the vertical position, which allows it to tilt around horizontal axis only along with the user's arm and to keep it with an opportunity to rotate the apparatus around the vertical axis only along with the apparatus user's body. This can be provided by creation of a special pocket on user's jacket for locating apparatus as depicts on FIG. 015. In this case the antenna 02, FIG. 020 could be used as a support for keeping the device rotating around vertical axis only along with the user's body. The antenna 02 is equipped with the hinge joint antenna holder 48 FIG. 020, FIG. 021, which allows bending antenna by up to 90 degrees in the direction 49. However, the same hinge joint antenna holder 48 does not allow moving antenna 02 around vertical axis 50 of the apparatus 01 FIG. 021. This simple feature could be a solution for the proper apparatus 01 positioning and its operating in alert safety mode 10 FIG. 002.

The apparatus 01 FIG. 001 (U-Minder) is specially designed and is a solid heavy duty device made with the best possible quality for the environment and weather conditions, and intended for long time operation.

Figure 4:
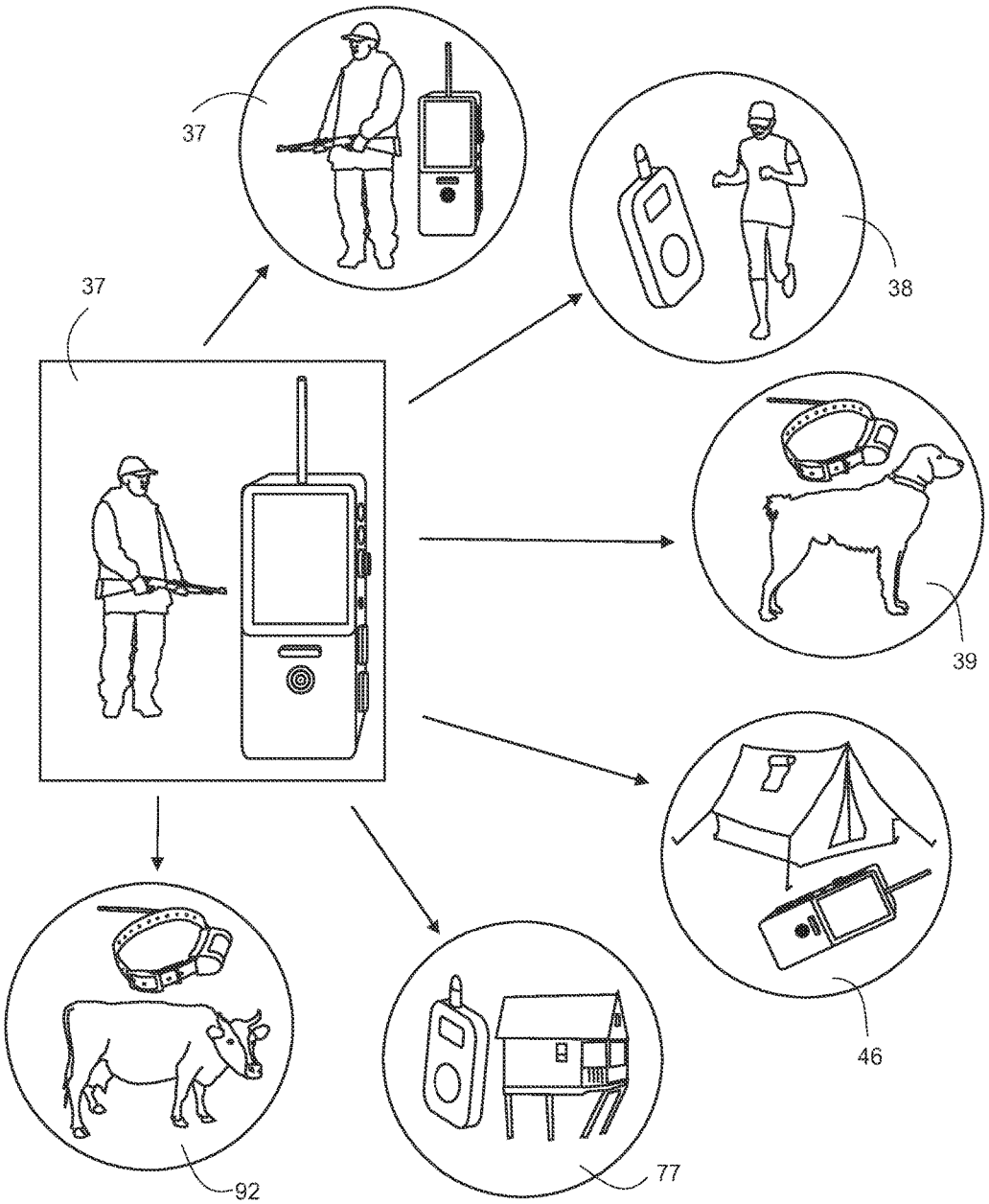
FIG. 004 Depicts protected by the apparatus and additional optional equipment users, passers-by and objects.

Users of the apparatus 01 FIG. 001 (U-Minder) are: professionals (forest rangers, geologists), hunters and other sport shooters 37 FIG. 004 and any outdoor enthusiasts 38 FIG. 004.

Figure 3:
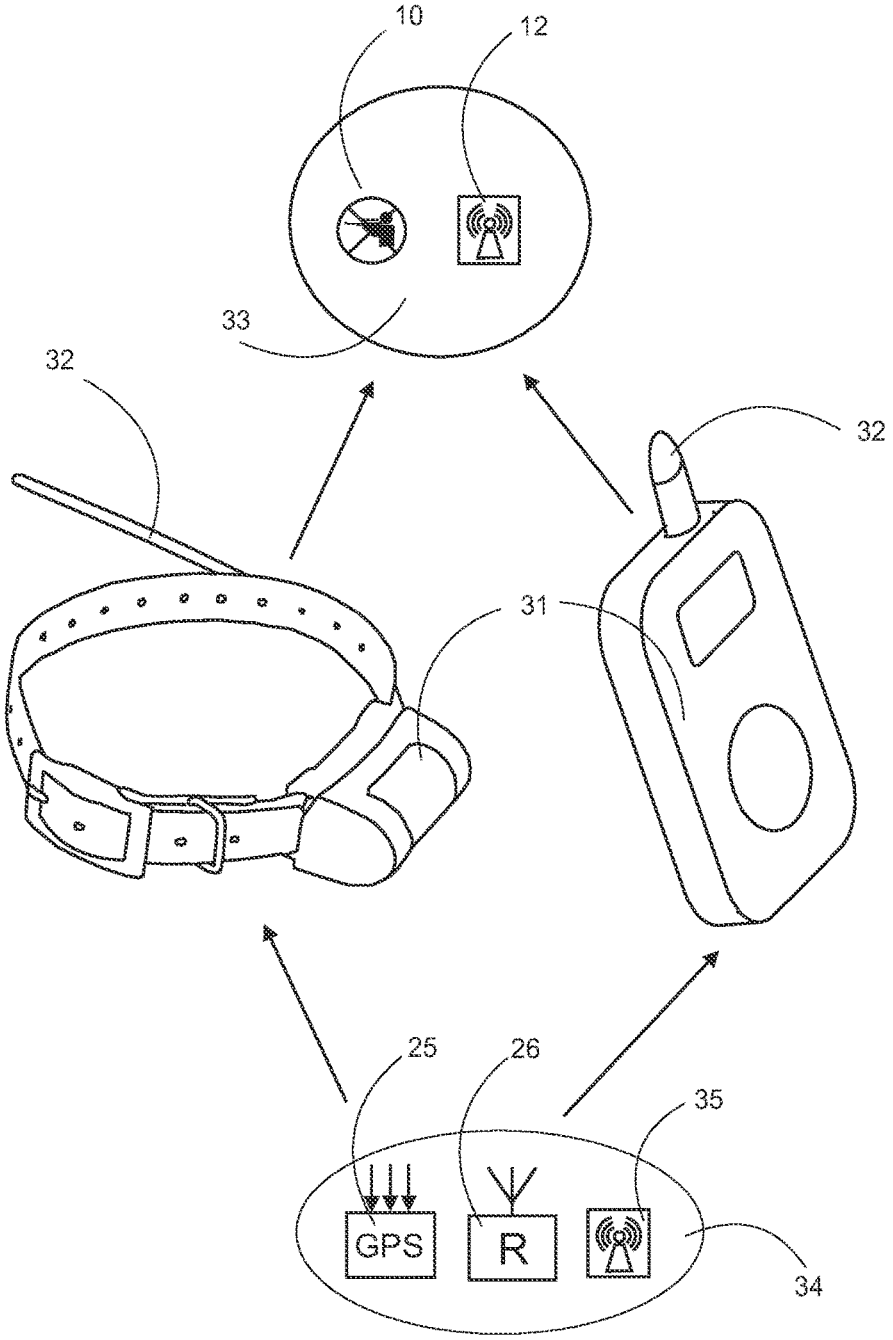
FIG. 003 Depicts additional, optional equipment units, which can be used with the apparatus.

The additional optional unit 31 FIG. 003 (B-Minder) has the similar functions as an ordinary GPS transmitting tracking device constantly producing and broadcasting by radio the beacon signal with its GPS coordinates, which is readable and visible by the apparatus 01. It is obvious that this unit 31 FIG. 003 can be equipped with the solar cell power charging system for long time operation. The difference to the apparatus is that this unit 31 FIG. 003 has only the beaconing function/mode 12 FIG. 003. It is obvious that its cost is significantly less than the cost of the apparatus as a result the sale price is decreased accordingly.

The optional unit 31 FIG. 003 is a beaconing device (B-Minder). The users of it are: Passers-by, as well as hunting dogs and any other objects 38, 39, 46, 77, 92 FIG. 004

Advantage of the optional unit 31 FIG. 003 is the low price comparing to the apparatus 01 FIG. 001.

Disadvantage of the optional unit 31 FIG. 003 (B-Minder) is the absence of any other features except safety radio signal beaconing.

Figure 26:
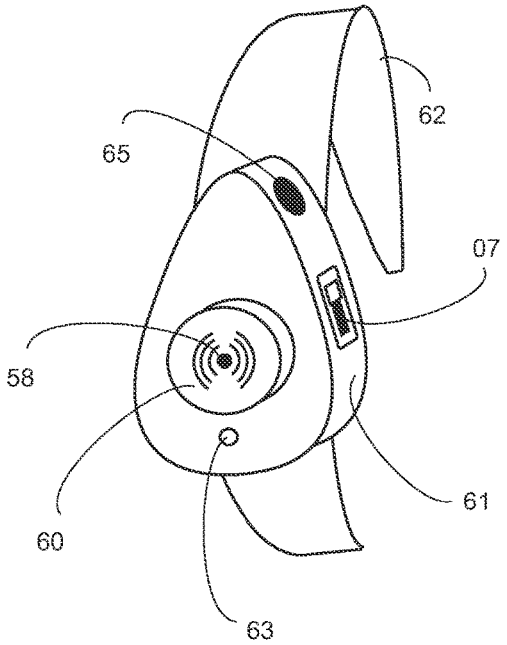
FIG. 026 Depicts the Wireless Remote Control appearance.
Figure 27:
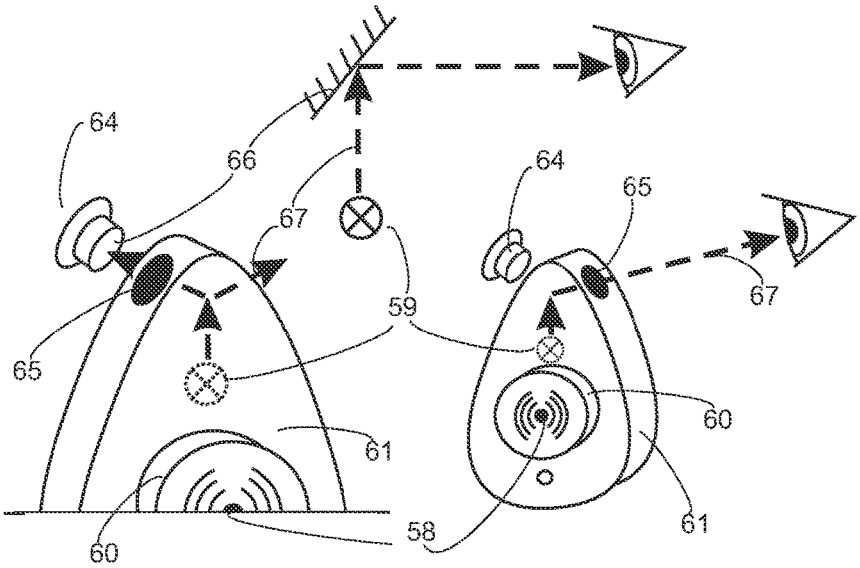
FIG. 027 Depicts the mirror cap and the Wireless Remote Control operation.
Figure 27:
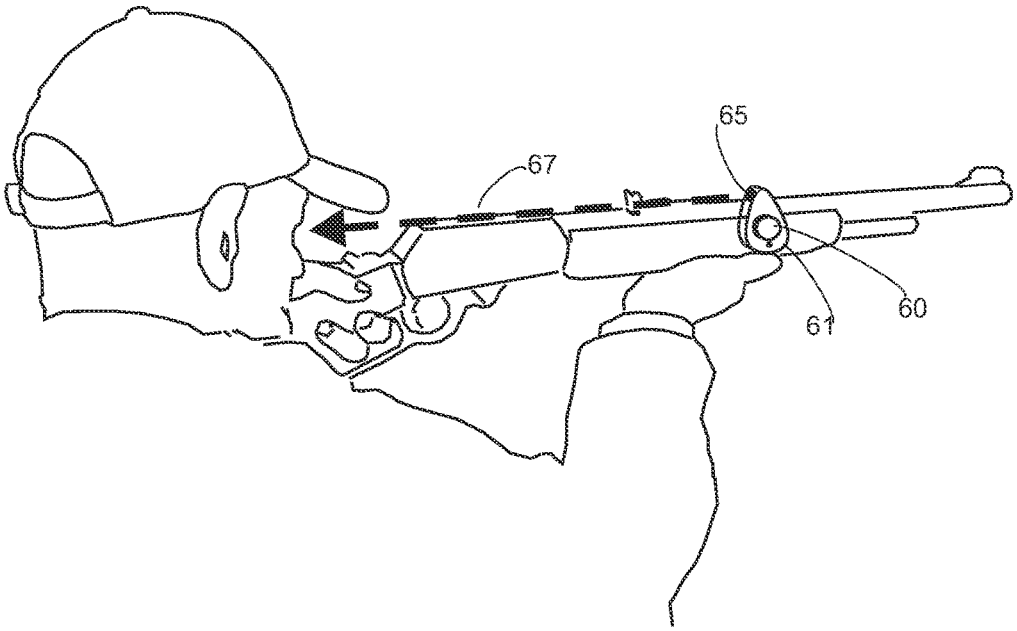
Figure 33:
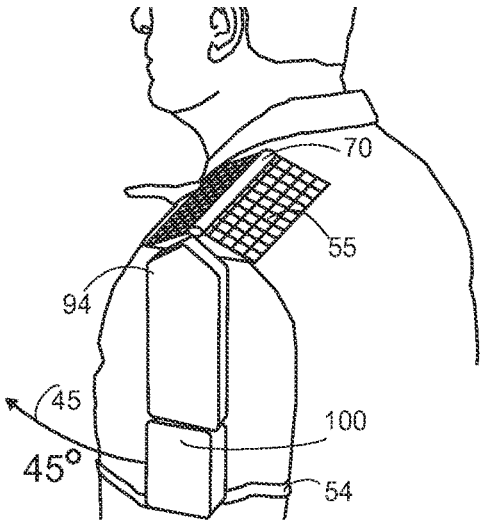
FIG. 033 Depicts T-Minder (transformer) the adapter and durable protective enclosure and holder with additional compartment for external cell phone optical zoom, equipped with solar cell charging system, intended for outdoor activities and for preventing shooting accidents in the sport of hunting and shooting by alerting a shooter about unsafe shooting due to the presence of humans or hunting dogs, or other protected objects in the zone of shooting by alarm signals.

The optional wireless remote control unit 61 FIG. 026 is designed for users with hearing impairments or those who prefer manual control of the alert function of a potentially unsafe shooting. This unit allows to activate the system by pressing the button 60 FIG. 026 and to see (light) 67 FIG. 027 and to feel (vibration) 58 FIG. 027 the signals and/or to hear a sound signal from apparatus' 01 speaker 06 FIG. 001.

the adapter-transformer (T-Minder) FIG. 033 is the device, which allows transforming the ordinary smart cell phone into the simplified inexpensive device similar to the apparatus 01 FIG. 001 with its main features.

The basis for the adapter-transformer FIG. 033 T-Minder is the idea of the epaulet apparatus holder and battery solar charging system with supporting equipment 69 FIG. 019.

Figure 32:
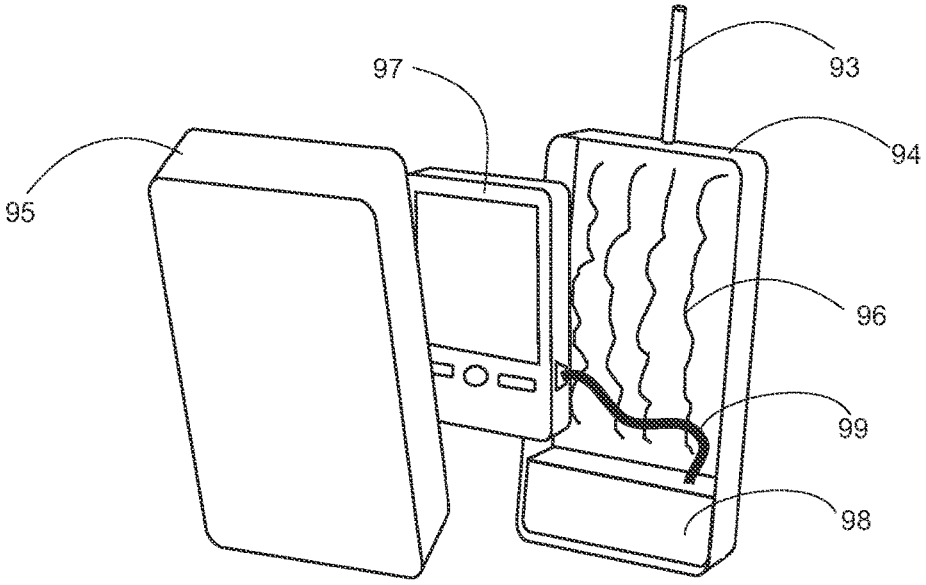
FIG. 032 Depicts the adapter and durable protective enclosure for a smart cell phone equipped with additional power battery, modulator RF frequency adapter, and additional antenna amplifier made for converting the ordinary smart cell phone into the universal assisting electronic device with automatic alert safety feature.

However, instead of holder/enclosure 47 FIG. 019 is used the compartment 94 FIG. 032, the plastic box with foam or other material glued inside of this box used as a filler for the purpose to use said compartment as the universal protective holder enclosure for different size smart cell phones.

the compartment 94 FIG. 032 contains the department 98 FIG. 032 where inside is additional rechargeable power battery and circuit board with updatable firmware (not shown) which allows to provide the smart cell phone 97 FIG. 032 with additional features.

Cable 99 FIG. 032 connects the smart cell phone using its USB port with the adapter-transformer depicted on FIG. 033.

The compartment 100 FIG. 033 is intended for carrying any additional optional devices chosen by user. For example, optical zoom, etc.

The users of the adapter-transformer FIG. 033 (T-Minder) are amateur hunters and other sport shooters 37 FIG. 004, FIG. 004 who seldom participate in these activities and who have a limited budget for these activities.

Advantage of the adapter-transformer FIG. 033 is that a user can use his smart phone for additional purposes without significant investment, he will have his favorite smart cell phone with him, charged and protected from mechanical damage or bad weather, user will be protected from a hunters' stray bullet, and his hands will be free for other activities (fishing, hunting, mushrooms collecting, etc.)

Disadvantages of the transformer (T-Minder) FIG. 033 is that it is the compromised solution. It is obvious that not all cellphones can support all features and be compatible for all tasks especially for safety mode 10 FIG. 002 alert on unsafe shooting. For example, the built-in smart cell phone GPS has to be able to work independently from the wireless network used for cell phone operation, etc. It is obvious that operation could be not as convenient for user as the apparatus 01 use. For example, for photo and video mode its user has to open the compartment 94 FIG. 032 and take the cell phone in their hands, and in some cases user has to open compartment 100 FIG. 032, take the optical zoom and attach/mount it to the cell phone and then start taking pictures. Instead of this the apparatus 01 will be ready for taking pictures in less than 3 seconds. This issue can be crucial, for example, if a user wishes to take a shot of animals which will not wait for his preparation. However, the smart cell technology is promising for the future due to constant development.

The apps (software) installed in the smart cell phone is made in addition to its ordinary features to operate as the beaconing safety device (S-Minder, not shown). This new safety feature is intended to prevent shooting accidents in the sport of hunting and shooting by alarm sound signal made by the smart cell phone alerting a shooter about unsafe shooting due to his presence in the shooting zone.

Users of this smart cell phone with installed safety software (S-Minder) are: hunters, passers-by, as well as any other objects 38, 46, 77 FIG. 004.

Advantage of the S-Minder is that the cell phone can contain the beaconing safety feature with any changes to its hardware or design.

Disadvantage of the S-Minder is that the smart phone has to have the built-in GPS working independently from the cell phone communication network and also the smart cell phone has to have the two way radio feature where the RF frequency is also a matter of compatibility with the safety beaconing feature.

The radio electronic system V-Minder works similar to the apparatus warning feature installed in the vehicle for the purpose not to miss or allow to view alarm signals of first responders' vehicles not visible behind obstacles from inside of other vehicles and intended for alerting a driver of a vehicle by a visible (light) and/or vibrating signal located in front of the driver or activating an automatic driverless vehicle's robotic system of necessity to clear the way for first responders' vehicles with activated warning signals following behind or crossing an intersection ahead of the ordinary vehicle.

Figure 30:
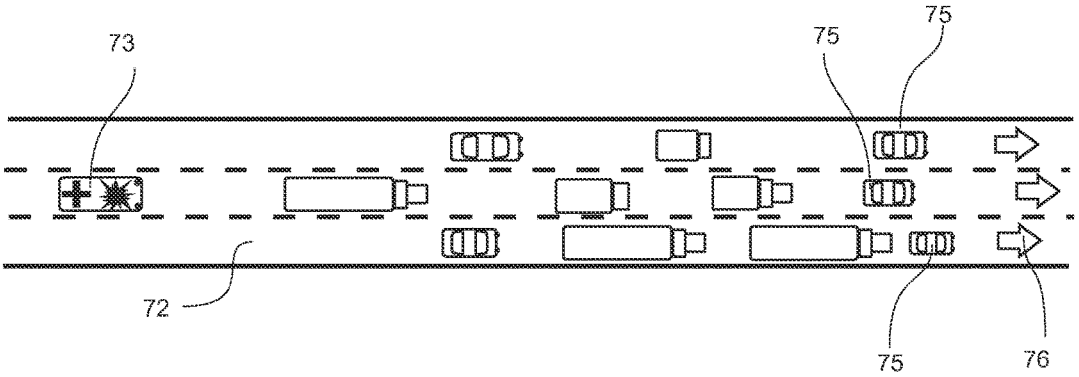
FIG. 030 Depicts a typical situation on the road when the ordinary vehicle driver cannot not see or hear the alarm sound and light signals of the first responders' vehicles.

FIG. 030 depicts the typical traffic situation on the road. The drivers of the ordinary vehicles 75 FIG. 030 cannot see the alarm light signals of the ambulance following behind because several larger size vehicles completely cover the available view in the rear view mirror inside and outside of a vehicle. In day time and in sunlight at the distance of a few hundred meters the light signals behind the obstacles are totally invisible. The drivers cannot hear the alarm sound signals because of the noise of a truck or train when it is too close. In addition the driver is using the loud radio or music. It is obvious that if the alarm sound and light signals will appear right behind the vehicle the driver will see and hear it and will clear the way. In reality the first responder's vehicle moving in traffic is practically pushing off the road one car after another wasting time and creating an accident situation. As a result of this, according to statistics it costs human lives due to delay with medical services, or fire, or criminal activity, or traffic accidents provoked by the first responders themselves.

Figure 11:
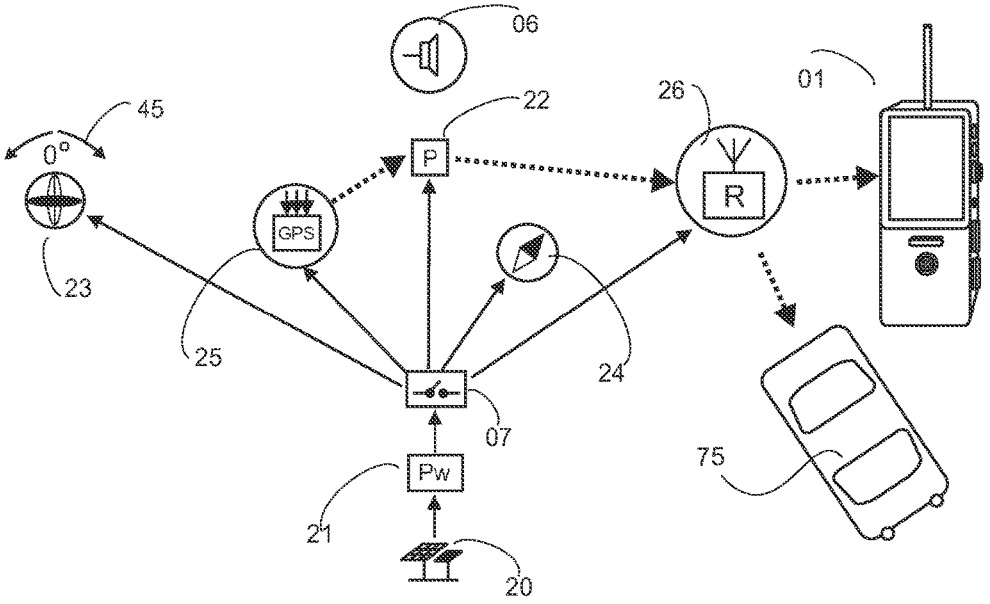
FIG. 011 Depicts the scheme of the RF signal broadcasting in the safe beacon mode in the sport of shooting and hunting and signal broadcasting by the first responder's vehicle.
Figure 12:
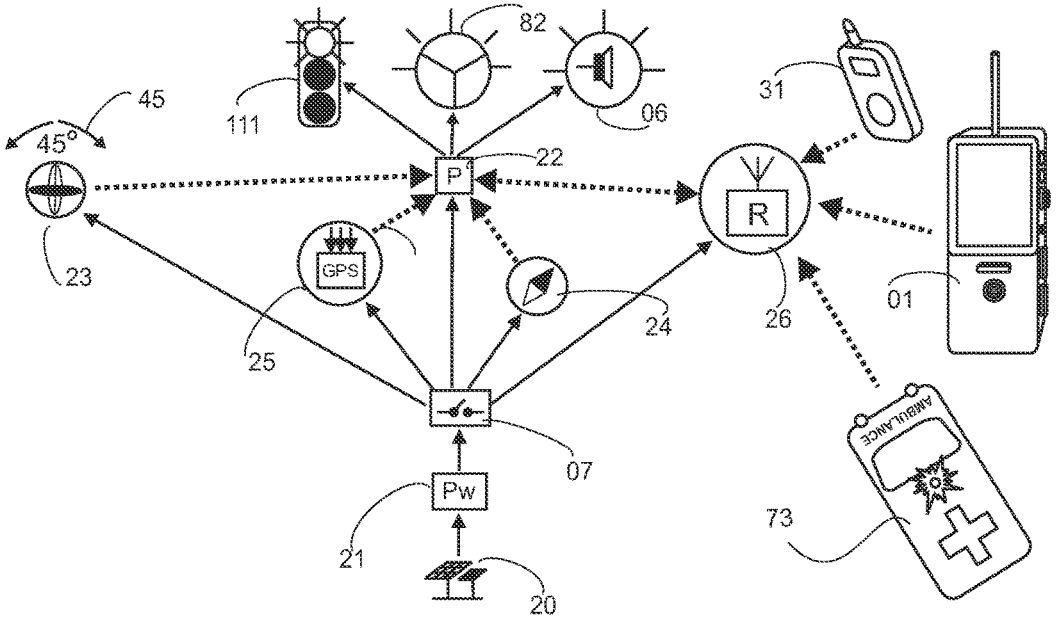
FIG. 012 Depicts the scheme of the apparatus automatic triggering for checking of the shooting zone prior to shooting and alerting the shooter about the unsafe shooting in the sport of shooting and hunting and automatic receiving by the ordinary vehicle the signal broadcasted by the first responder's vehicle and warning by the alarm signals the driver of the ordinary vehicle about the necessity to clear the road.
Figure 13:
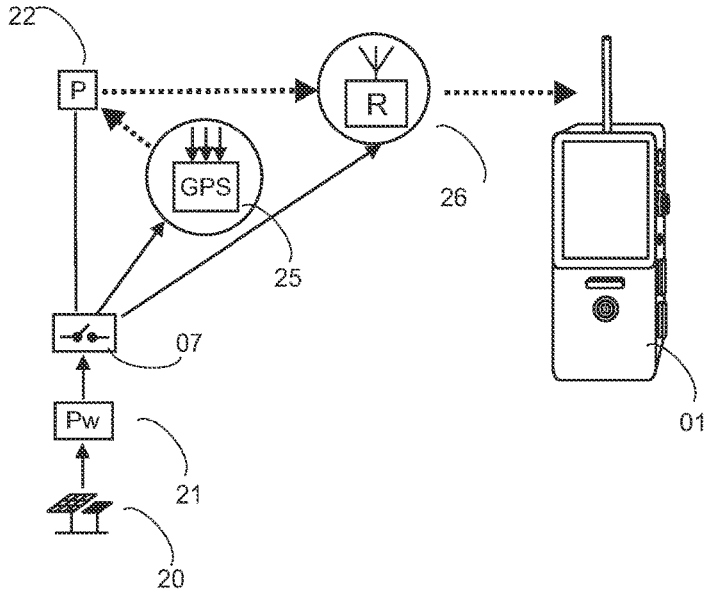
FIG. 013 Depicts the scheme of the RF signal transmitting by the additional optional unit.
Figure 14:
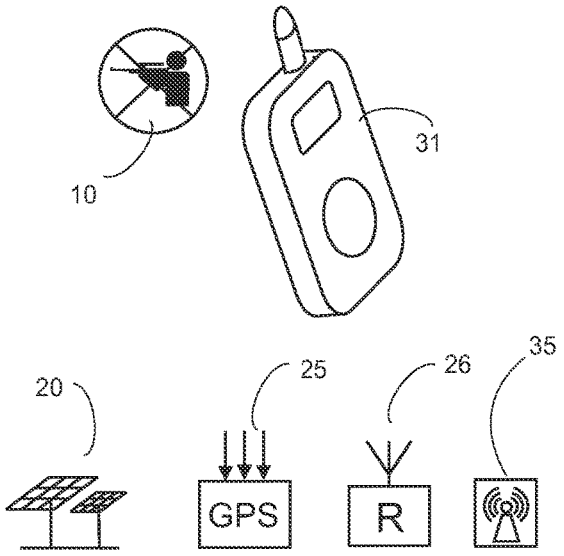
FIG. 014 Depicts the main function and equipment of the additional optional unit.

The radio electronic system V-Minder proposes the solution. If the driver of the first responders' vehicle activates the alarm light signals he is simultaneously switching on the safety radio beaconing signal, which broadcasts the changing in real time GPS coordinates of said first responders' vehicle 73 FIG. 030. This signal is received by all ordinary vehicles equipped with V-Minder. The GPS receiver and signal processing system of the ordinary vehicles are calculating the location of the first responder's vehicle with activated alarm signals relatively to the ordinary vehicle 75 FIG. 030. All process of the V-Minder is similar to the work of the apparatus 01 warning feature. The diagrams FIG. 011 show the operations of the first responders' vehicle and the FIG. 012 shows the operation of the V-Minder of the ordinary vehicle. In the V-Minder the accelerometer with gyroscope 23 FIG. 011 is absent because the switching ON for broadcasting of the GPS coordinates beaconing signal FIG. 011 is the switching ON of the alarm signals of the first responders vehicles. So, instead of accelerometer 23 the first responder's vehicle starts beaconing by the alarm switch of said vehicle 73 FIG. 030. The RF receiver of the ordinary vehicle 75 starts working and is permanently switched ON when the vehicle starts its engine. So, the accelerometer 23 FIG. 012 in the ordinary vehicle is also absent.

Figure 29:
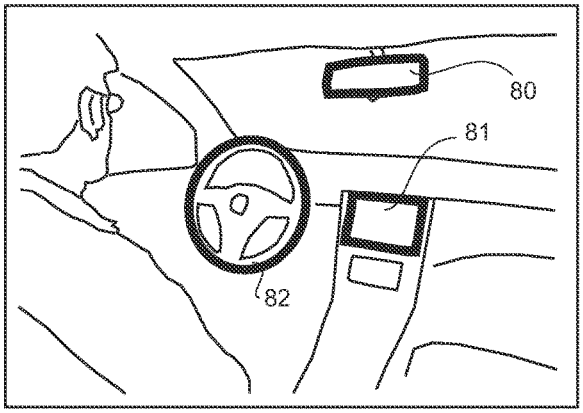
FIG. 029 Depicts possible optional alarm signals location inside vehicles.

If the first responder 73 FIG. 030 is located on the road in the preset monitoring zone behind the ordinary vehicle 75 FIG. 030 and is moving in the same direction, the light 80, 81, and vibration 82 signals FIG. 029 inside of the ordinary vehicles will be automatically activated and cannot be ignored by a driver FIG. 029 who must follow the by-law procedure for clearing the road.

Figure 31:
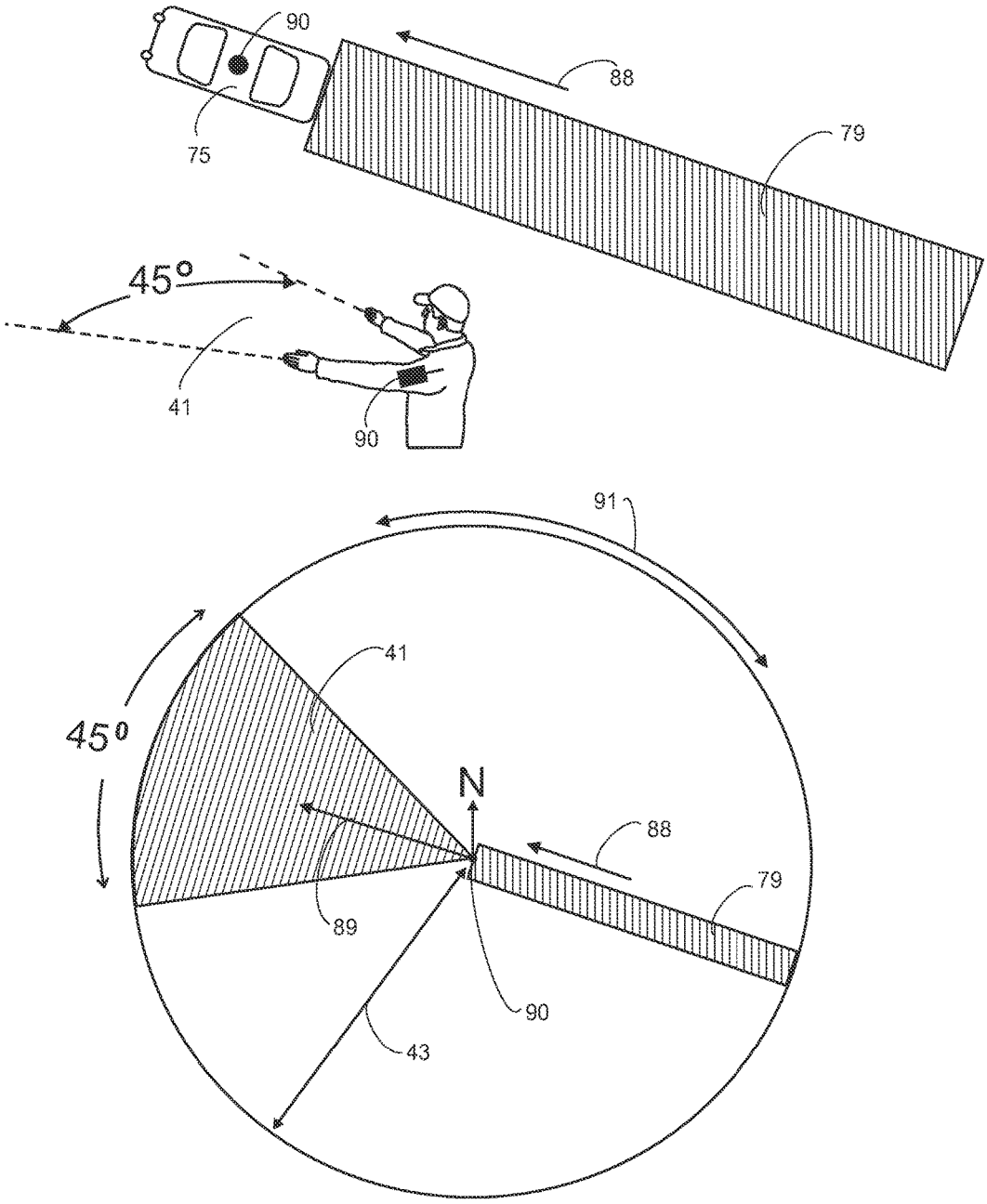
FIG. 031 Depicts the diagrams of the method of alerting the weapon shooter about unsafe shooting in the sport of hunting and shooting, and using the same method of automatic alerting the driver of an ordinary vehicle about necessity to clear the way for the first responders' vehicles with activated warning signals following behind.

The difference of V-Minder operation comparing to the apparatus 01 is that the monitoring zone for the V-Minder is preset behind the vehicle 79 FIG. 031. As shown on FIG. 031 the device 90 similar to the apparatus 01 in V-Minder case is located in a car and is monitoring the preset zone behind the vehicle but in case of the sport of shooting and hunting the apparatus shown is monitoring the preset zone in front of the shooter. However, both systems use the same method of warning.

Figure 28:
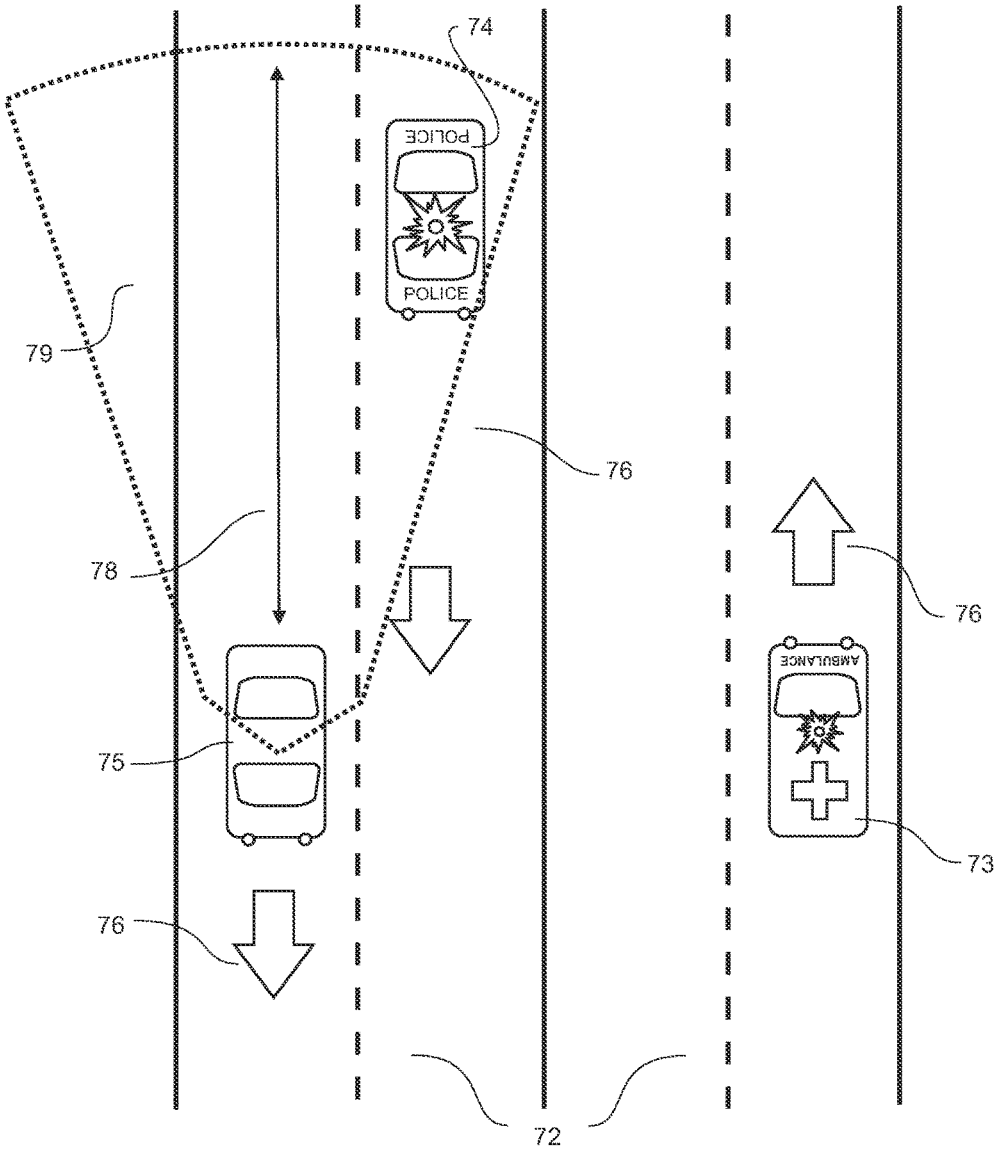
FIG. 028 Depicts the road with vehicles and the preset zone of monitoring intended for the automatic activation of the alert signals inside the ordinary vehicle if the first responder's vehicle with activated alarm signals will appear in said zone of monitoring.

The V-Minder processor 22 FIG. 012 of an ordinary vehicle is taking into account and analyzing the coordinates of the first responders' vehicles 73,74 FIG. 028, its own coordinates coming from the GPS receiver 25 FIG. 012 accelerometer with magnetometer (digital compass) 24 FIG. 012. The analyzing of this information allows the signal processing system 22 FIG. 012 to determine the direction of moving of the first responders' vehicles and switch the alarm signals inside the car 80,81,82 "ON" only if the responder's vehicle is following behind moving in the same with the ordinary vehicle direction. The signal coming from the ambulance 73 FIG. 028 will be ignored. The signal coming from the police car 74 will be recognized as necessity to clear the way.

Figure 34:
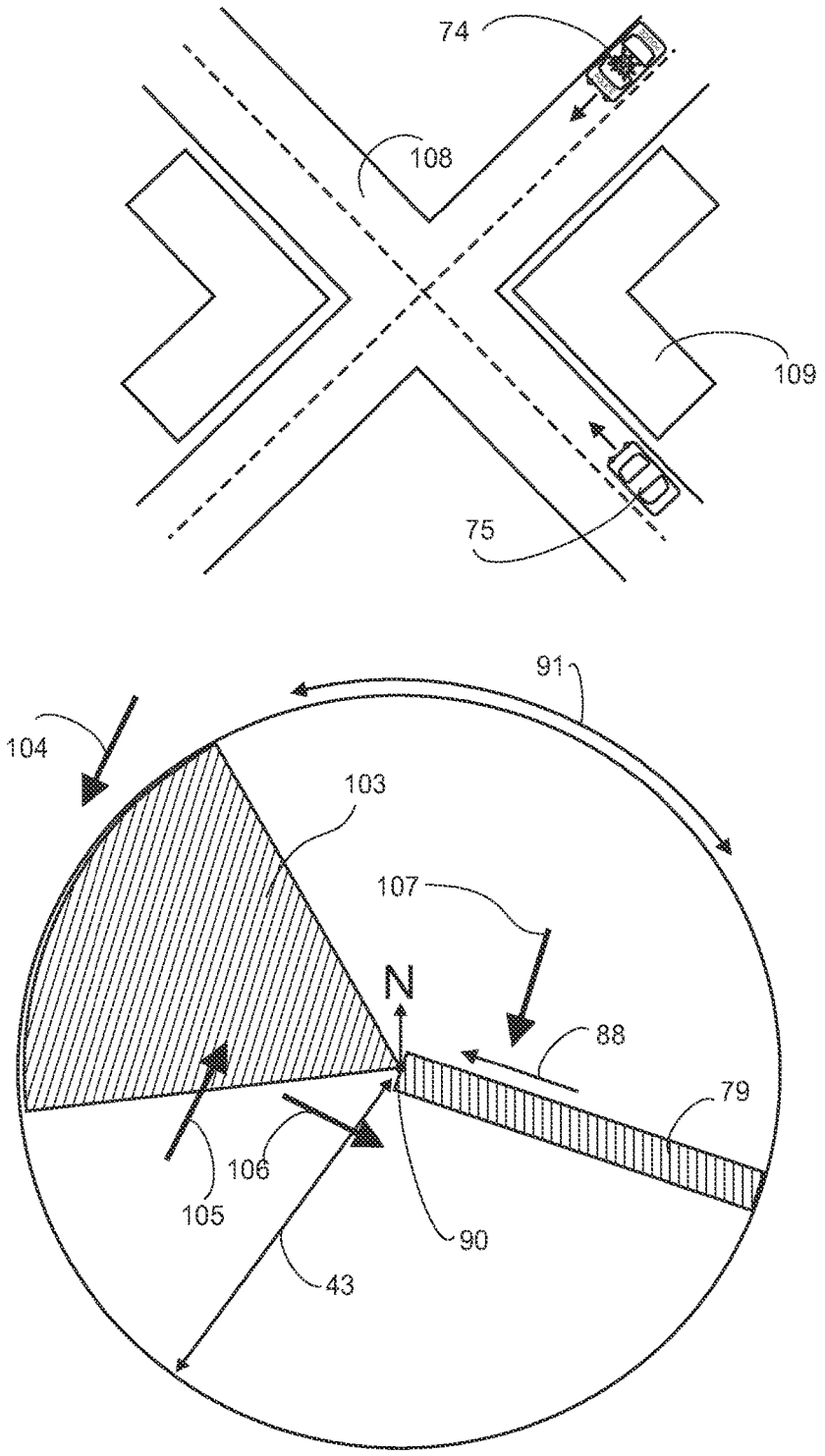
FIG. 034 Depicts the diagrams of the road intersection and vehicles intended to cross it and showing the preset monitoring zones on the road intersections located ahead of the moving vehicle as well as behind it.

The monitoring zone for ordinary vehicle as well as the zone of shooting in the sport of shooting and hunting is a matter of determination. The signals processing system 22 FIG. 012 can be programmed for monitoring and determining any preset zone by a manufacturer and/or by law and follow the preset algorithm of operation. The FIG. 034 depicts the intersection with moving vehicles. The driver of the ordinary vehicle 75 FIG. 034 cannot see the hidden police vehicle 74 FIG. 034 coming from behind the building 109 FIG. 034. However the built-in the ordinary vehicle 75 FIG. 034 V-Minder is determining that the first responder is crossing the way of the ordinary vehicle and warning the driver about it.

The diagram FIG. 034 depicts the first responders 104, 105,106,107 moving in different directions and located differently relative to the electronic equipment determining the safety zone 90 FIG. 034 built-in the ordinary vehicle. In this case only the first responder 105 FIG. 043 will be taken into the account. All others will be ignored. The first responder 104 FIG. 043 will be ignored because it is too far away. The first responder 106 FIG. 043 will be ignored because it is moving in opposite direction, possibly in a parallel street. The first responder 107 FIG. 043 will be ignored as it is intended to cross the way behind the ordinary vehicle.

the light signals inside of the vehicles can by split in separate segments showing from which side the first responder's vehicle is coming. The design of these signals is the discretion of the vehicles' designer and manufacturer.

The materials and components used for V-Minder as well as for any devices of this invention is well known and tested in the electronic devices. The modern vehicles are already equipped with GPS and radio, antennas, power supply light, sound and vibrating signals, etc. The slight changes in this part will make the ordinary vehicles as well as first responders' vehicles ready for cooperation on the road and for saving human lives.

The users of the electronic system V-Minder with the similar to the apparatus warning feature but installed in vehicles are:

all drivers of all ordinary and special vehicles moving on the roads.

The advantage of the V-Minder. Very economical and easy for design and manufacturing solution that will not even affect a user's budget for saving human lives by providing safety for the first responders as well as people who need their help and also by improving safety on the roads.

The disadvantage of the V-Minder: None.

Appearance of the V-Minder. All components are a part of the vehicles' electronics. Switching ON and OFF are made automatically. So, the V-Minder practically doesn't have an appearance. The visible part is only the light signal inside of a vehicle which could be designed differently and be a part of vehicles decoration, for example as depicted in FIG. 029. The other part which possibly could appear is the RF antenna. Due to the short range of operation the antenna cannot be big and negatively affect the shape of the vehicle. However the first responders' vehicles can be equipped with larger antennas as necessary.

The radio electronic system installed in the traffic lights and first responders' vehicles intended for automatic switching the color of the traffic lights to green (L-Minder) for clearing the way for the first responders' vehicles approaching said traffic lights with activated warning signals works similar to the apparatus warning feature.

Figure 35:
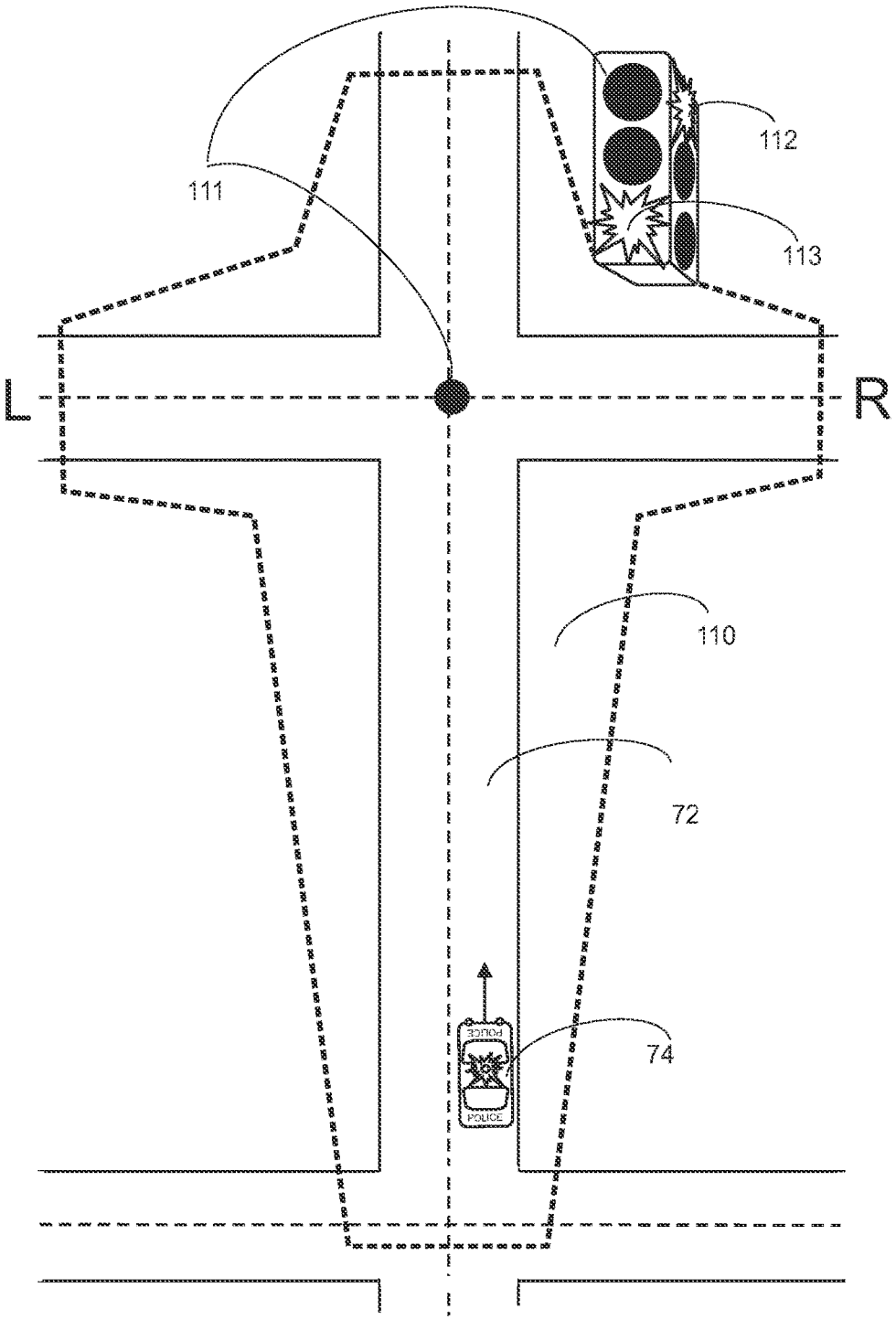
FIG. 035 Depicts the traffic lights location and its monitoring zone

The first responder's vehicle 74 FIG. 035 with activated alarm signals is moving to the intersection equipped with the traffic lights 111 FIG. 35. This vehicle is broadcasting beaconing signals containing its coordinates updated in real time. By approaching the monitoring zone of the traffic lights 111 FIG. 035 the vehicle 74 FIG. 035 is informing about its presence and direction of its movement.

The signal processing system 22 FIG. 012 of said traffic lights 111 FIG. 035 is analyzing the received information and determining the direction of the movement of the approaching vehicle 74 FIG. 035 and automatically turning the green light ON 113 FIG. 035 and simultaneously closing the way crossing the road 72 FIG. 035 from the left and right sides by turning the red light ON 112 FIG. 035.

After the vehicle 74 FIG. 035 will pass the intersection, the traffic lights 111 FIG. 035 will be automatically returned to its standard regime mode.

The monitoring zone 110 FIG. 035 for the traffic lights 111 FIG. 035 can be preset individually depending on the environment and by the local law requirements by a service employee using an external device (laptop or tablet with preinstalled software made for this purpose) capable to make a correction in the traffic lights' apps. For this operation the traffic lights' electronic equipment has a port similar to the port 85 of the apparatus 01 FIG. 001.

Said software of the L-Minder is based on the traditionally used with the GPS devices and in the smart cell phones equipped with the GPS functions.

While using the same method the difference with the apparatus 01 FIG. 001 (U-Minder) as well as with the V-Minder is that the traffic lights are not moving. So, it is possible to simplify the design of the electronics of the L-Minder. It is obvious that as power supply will be used the energy of the traffic lights. So, additional batteries are not required.

The advantage of the L-Minder (the radio electronic system installed in the traffic lights) is that it is the most economical solution for preventing accidents with participation of the first responders' vehicles on the intersections equipped with the traffic lights. The L-Minder can be used by the local municipal first responders because the installation of the beaconing device broadcasting the coordinates of the first responders' vehicles as well as installation of the electronic equipment in the traffic lights of local area can be made at any time by the decision of local authorities. Even equipping with the L-Minder just one of the traffic lights units can positively affect the quality of the local public services.

The L-Minder is improving and completing the idea of V-Minder operation because they use the same method, technology and radio frequency, which provide the cooperation with each other.

Appearance of the apparatus 01 FIG. 001.

The dimensions of the device are a matter of design. It has to be as small and light as possible and big enough for enclosing all necessary components, which will provide all necessary features and functions such as GPS and command monitor 09, high capacity battery and be convenient for users. The apparatus appearance will be similar to a miniature video camera as shown on FIG. 001 or a smart cell phone with an additional antenna 02. The dimensions of the antenna 02 is the matter of testing. It has to be big enough to provide in combination with RF amplifier and chosen RF frequency stable signal reception in the range of over 1 km in wet weather forest environment and also to provide a stable two-way voice radio communication as a typical walkie-talkie device. The housing of the apparatus has a convenient form. Due to its method of mounting the apparatus can have an elongated shape which will have enough room for a powerful battery.

Appearance of the solar cells epaulet (shoulder strap) holder and battery charging system 69 FIG. 019 for the apparatus 01 FIG. 001.

The appearance of said system 69 FIG. 019 is a matter of the product design, which depends on the device purpose and must provide the best solution. The purposes of the unit 69 are:

to store, hold, protect and keep in proper position the apparatus 01 during operation and/or during any other activity of its' user.

to charge the power battery of the apparatus 01 during its operation or in a passive mode.

FIG. 019 depicts the idea of said system 69. The size of solar cells panel 55 FIG. 019 must be big enough for providing enough energy for charging the apparatus battery.

The internal volume of the enclosure/holder 47 FIG. 019, FIG. 020, FIG. 021 by its size is equal to the apparatus size and works as protecting box for the apparatus.

The supporting hard plastic stick 53 FIG. 019 is attached to the enclosure/holder 47. FIG. 019

The plastic stick 53 FIG. 019 and the supporting leather, rubber or fabric holder strap designed to keep enclosure/holder 47 moving along with the user's arm. It has to be designed conveniently for the user and not bother him during any activity.

The support for the enclosure/holder 47 FIG. 019 and antenna compartment 70 FIG. 019 is an optional solution. It is proposed for the user's convenience and the apparatus 01 antenna's 02 FIG. 001 protection from potential accidental damage by a backpack or rifles' belt, etc.

Appearance of the optional additional device unit 31 FIG. 003 B-Minder.

Depicted on FIG. 003 unit 31 with the same functions looks differently. The appearance depends on the purpose of the unit use and it is a matter of product design; if the unit is intended for a hunting dog it requires a collar for mounting, a human can simply put the unit in the pocket. However, if a long time operation is in order, a product designer has to think about solar cells charging equipment or find another solution.

Appearance of the optional Wireless Remote control 61 FIG. 026.

Figure 24:
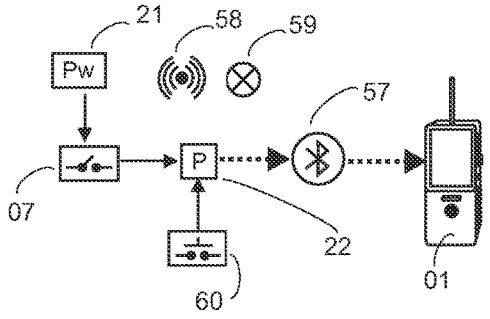
FIG. 024 Depicts the scheme of the activation of the apparatus by the Wireless Remote Control.
Figure 25:
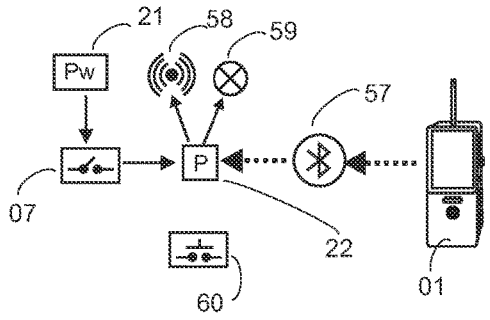
FIG. 025 Depicts the scheme of the activation of the selected alert signals of the Wireless Remote Control.

As depicted, the device has the body/enclosure big enough for locating the short range radio transceiver 57 FIG. 024, FIG. 025 with the power battery 21, switch ON/OFF 07, equipment for light and vibration signals, testing press button 63 FIG. 026 and a large activation button 60 FIG. 26. The total size of this unit is about the size of a smallest version of a computer mouse. The unit is equipped with an optional mounting belt/strap fastener 62 FIG. 026 intended to attach this unit to a weapon. The design of the belt/strap fastener 62 FIG. 026 can be different as well as the design of the unit housing if it provides the unit's functionality and convenience for users.

Operation

Operation Modes

The apparatus 01 FIG. 001 stays in the default mode "alert on unsafe shooting" 10 FIG. 002 if the apparatus 01 is activated by the power button 07 FIG. 001 switched in the ON position. If the power button is switched OFF and if the apparatus is placed in the holder/enclosure 47 FIG. 019, FIG. 020 the apparatus is staying just in the battery charging mode.

Figure 16:
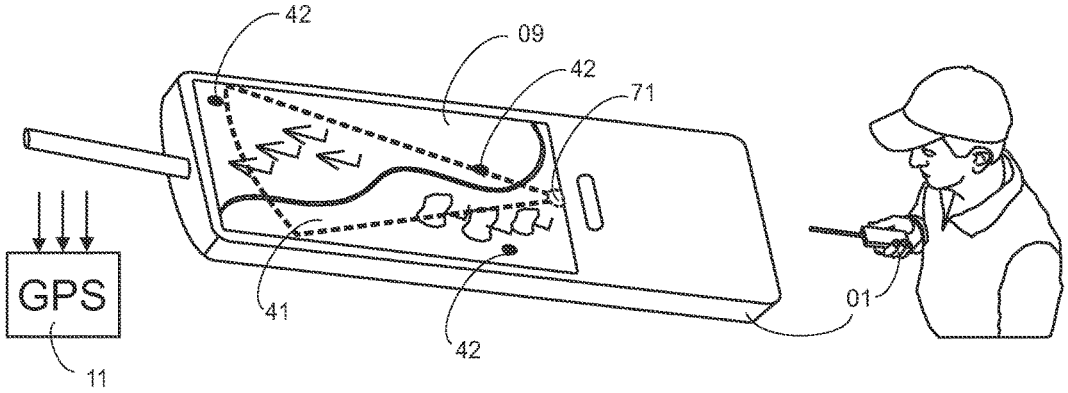
FIG. 016 Depicts the apparatus operating in GPS/GLONASS receiver mode, which allows seeing the location of the apparatus user on a map as well as other users equipped with the similar devices.

The apparatus will be switched to the GPS mode 11 FIG. 002 automatically by detaching apparatus 01 from the holder/enclosure 47 FIG. 019, FIG. 020, and taking it in the user's hands FIG. 016 or it can be preset by user to any other mode using touch screen 09 FIG. 001.

Figure 17:
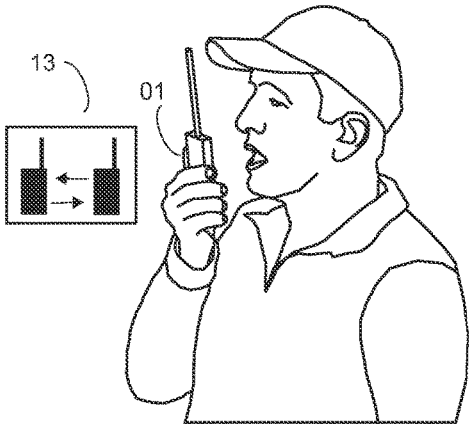
FIG. 017 Depicts the apparatus operating as a "walkie-talkie".
Figure 18:
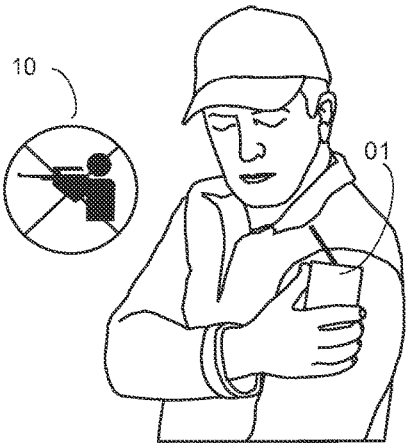
FIG. 018 Depicts the apparatus placement for operating in stand-by, beaconing, triggering, alerting, and battery charging modes.

The device is switched to the walkie-talkie mode 13 FIG. 017 by detaching the apparatus from the holder/enclosure 47 FIG. 019, FIG. 020, and taking it in the user's hands FIG. 018 and by pressing speak/listen button 03 FIG. 001.

All other features 29 FIG. 002 are operating by the multifunctional programmable button 04 FIG. 001 after switching its function by the touch screen command display 09 FIG. 001.

By plugging the apparatus 01 into the holder enclosure 47 FIG. 019, FIG. 020, the apparatus 01 FIG. 001 starts the apparatus' battery 21 FIG. 011, FIG. 012, FIG. 002 charging using the solar cells 20 FIG. 011, FIG. 12 built-in in the epaulet (shoulder strap) battery charging system 55 FIG. 019.

Operation in the mode "Be careful, shooting is possibly unsafe"10 FIG. 002.

By switching ON the main ON/OFF power button 07 FIG. 001, FIG. 11, FIG. 12 and plugging the apparatus into the holder enclosure 47 FIG. 019, FIG. 020, the apparatus starts working in the mode—alert on unsafe shooting 10, and simultaneously starts the apparatus' battery 21 FIG. 011, FIG. 012 charging from the solar cells 20 FIG. 011, FIG. 012 of the epaulet (shoulder strap) battery charging system 55 FIG. 19.

The signal processing system 22 FIG. 11 starts constantly broadcasting by radio with antenna amplifier 26 FIG. 011 the coordinates of the apparatus 01 determined by GPS receiver 25 FIG. 11 in the beaconing mode with the preset frequency of impulses which will be received by another apparatus or similar device.

Another similar device or apparatus 01 FIG. 011 receives this signal and its' signal processing system 22 FIG. 012 calculates this information and stores it together with its' own GPS coordinates. The purpose is to combine this apparatus coordinates with coordinates from the apparatus which transmits the signals, or from all other similar devices' signals which have been received by the apparatus. So, the apparatus stores the locations of all similar units and calculates their location relatively to the receiving unit. This information is received and calculated in real time by the shooter's apparatus and is used for automatic alerting of its user if the shooting is unsafe, meaning that another apparatus 01, or optional units 31 FIG. 003, or similar device is present in the zone of shooting 41 FIG. 010. For correct functioning the apparatus in the safe mode 10 FIG. 002 must be located as depicted on FIG. 019.

Figure 8:
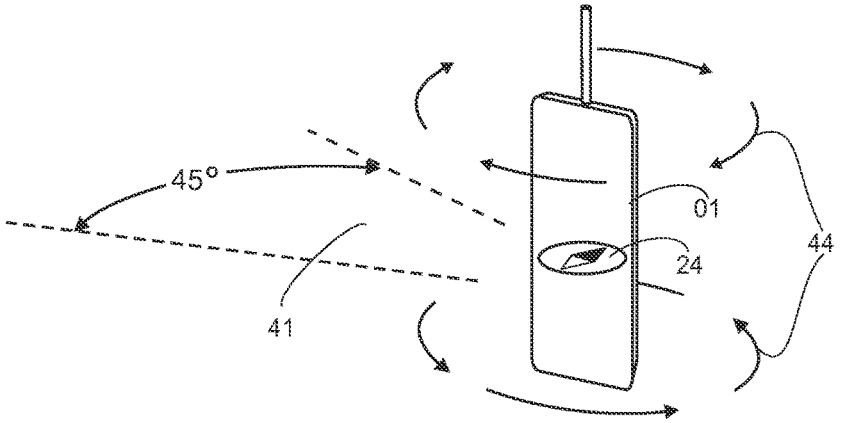
FIG. 008 Depicts the apparatus' targeting angle and the safe for shooting zone direction.
Figure 9:
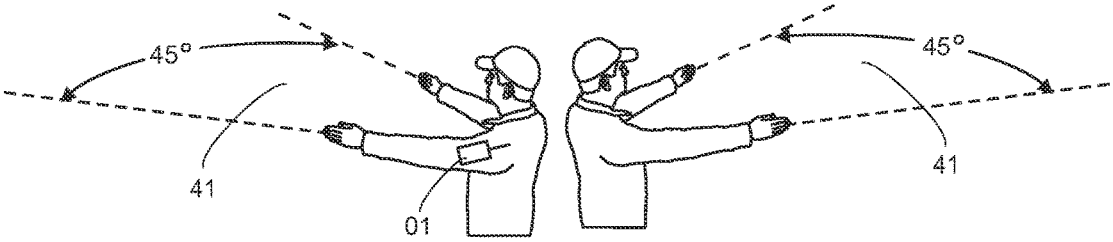
FIG. 009 Depicts a standard for hunters' method of determination of the safe zone for shooting.
Figure 10:
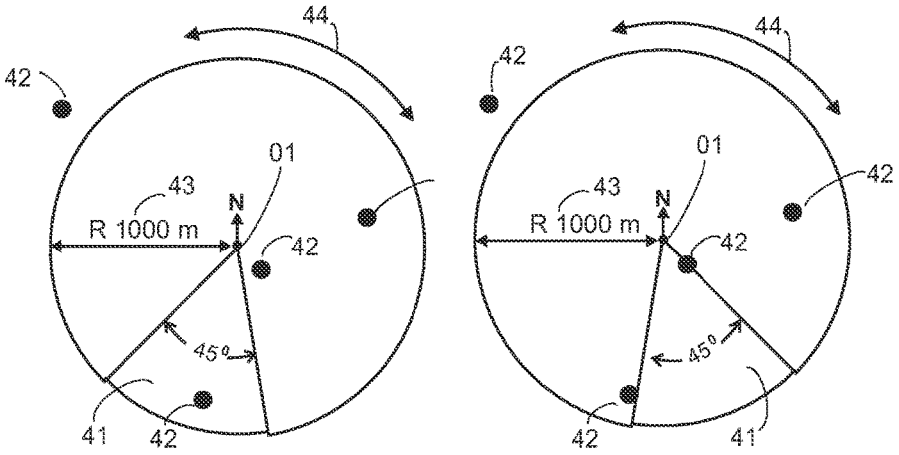
FIG. 010 Depicts the diagram of the method of the location determination of hunters and passers-by in a shooting area by electronic devices.

A standard safety precaution requires hunters and shooters to figure out before shooting the zone of shooting for checking it for safety, which is the sector of 45 degree angle directed from the shooter's face towards the planned shooting direction. The shooter has to use his hands for determining of the 45 degrees zone for his shooting 41 FIG. 009 and must ensure that no human or dogs, etc. are present. The apparatus 01 is designed to follow (imitating) this safety instruction/precaution. The apparatus' signal processing system 22 FIG. 012 using the built-in GPS maps determine the preset range 43 FIG. 010 and the safe sector 41 FIG. 010. The apparatus is located as depicted on FIG. 019 in the fixed position and its coordinates are calculated and combined by the signal processing system 22 FIG. 012 together with the data collected from the built-in accelerometer combined with magnetometer 24 FIG. 012. So, the rotation of the apparatus 01 around its vertical axis 44 FIG. 008, FIG. 010 is possible only together with the apparatus user's (shooter's) body and will rotate the zone of shooting (sector) 41 along with the apparatus FIG. 008, FIG. 010 and together with the user's body. The apparatus 01 and its signal processing system 22 FIG. 012 collect information on all other users' beaconing apparatuses or optional units or similar devices' 42 FIG. 010 locations and calculate relatively to the receiving apparatus 01. If any of units are located in the zone of shooting 41 the apparatus informs its user about it, meaning that shooting is unsafe.

Before shooting the shooter is targeting his weapon as depicted on FIG. 015. This move rotates the apparatus 01 equipped with the accelerometer with gravity and gyroscope sensors 23 FIG. 012 around its horizontal axis FIG. 015, This sensor 23 FIG. 012 is switching ON the request to the signal processing system 22 FIG. 012 if in the zone of shooting is present another apparatus 01, or additional unit 31 FIG. 003, or another similar device, the signal processing system 22 FIG. 012 activates the sound alert signal by speaker 06 FIG. 012. It means that shooting is unsafe. Otherwise, the receiving device unit 01 remains silent and the decision to shoot or not to shoot is left at the shooter's discretion. All apparatuses 01 in alert on unsafe shooting mode operate the same way.

Alternatively, for the apparatus 01 operation can be applied the request-response method of operation. In this case the apparatus 01 can be designed or preset for operation based on request-response signals. In this case the apparatus 01 and similar devices do not beaconing any signals. Before shooting apparatus 01 emits request signal and is waiting for response. Other units send response signal containing their coordinates. Then the apparatus 01 processes this signal as stated above. In this case the apparatus 01 has to calculate locations of other units relative to itself at the last moment before shooting instead of constantly transmitting and receiving the updated coordinates.

The request-response solution allows equipping the response units (apparatus 01 FIG. 001 (U-Minder), the smart cell phone with installed apps (software) for making it beaconing (S-Minder), smart cell phone with transformer-adapter FIG. 33 T-Minder) by alarm activated by the request signals coming from other units, meaning that the targeted user will be warned that he is located in the zone of shooting and it is unsafe for him. It allows him to make steps for protecting himself from a stray bullet (lie down on the ground, etc.).

The request-response solution will positively affect the energy use and make all system devices less visible for example, in case of military operations, etc. However the request-response solution could negatively affect the speed and stability of the apparatus operation, which in some cases could cause unsafe shooting. In addition the absence of beacon signals is making the apparatus 01 invisible for monitoring its location by GPS tracking of another apparatus 01, which in some cases could cause a problem to find a missing person. So, for civilian use the beaconing method is preferable on the request response method. The apparatus 01 design and its operational location allow equipping the apparatus 01 with a powerful battery. In addition the apparatus 01 can be equipped with the epaulet apparatus holder and battery solar charging system with supporting equipment 69 FIG. 019.

Operation in mode "GPS" 11.

The apparatus 01 user has the opportunity to monitor the location and coordinates of himself and other users by switching ON the apparatus 01 in GPS mode by detaching it from the enclosure/holder 47 FIG. 20 and taking it in his hands. The location of the apparatuses and other objects FIG. 004 equipped with similar to apparatus 01 devices or additional optional unit 31 FIG. 003 will be visible on the GPS map shown on touch screen 09 FIG. 016 of the apparatus 01. This feature will help to save the lives of the apparatus 01 and optional unit 31 FIG. 003 users if he/she is lost in the woods or is immobilized.

The apparatus 01 in its default position is switched in "sound alert on unsafe shooting" mode 10. In this case the apparatus is using the energy of the battery only for signals transmitting, receiving and processing, without their visualization. This will save energy because the activation of the apparatus' 01 display 09 FIG. 016 with the creating, moving and rotating GPS map image and keeping it bright will increase the power consumption of the power battery 21 FIG. 012.

Operation in mode "Walkie-talkie"13.

The walkie-talkie mode becomes available automatically when the user detaches the apparatus from the enclosure/holder 47 FIG. 20 and takes it in his hands. After pressing speak/listen button 03 FIG. 001 the user can start talking and use the apparatus 01 as an ordinary walkie-talkie. This feature will help to save the life of the apparatus 01 user if he is lost in the woods or partly immobilized by calling for help.

Operation in optional modes 29.

Detaching the apparatus 01 from its base holder/enclosure 47 activates the GPS and touch screen command display 09 FIG. 016. By touching it the user activates the menu for optional features 29 FIG. 002. By touching the menu's keys the user operates the optional features 29 FIG. 002 and activates the optional switchable button 04 FIG. 001 for operation of the chosen feature. By pressing the button 04 the user operates one of the optional chosen features. For example, photo camera 15, or video camera 14, flashlight 18, radio 56, etc. By plugging the apparatus back into the holder/enclosure 47 FIG. 020 the user switches the apparatus to the default alerting mode 10 FIG. 002 "shooting is unsafe". The beaconing mode 12 FIG. 002 is constantly switched ON and works simultaneously with any other modes while the general power switch 07 of the apparatus 01 is switched "ON" FIG. 001.

The optional, additional wireless devices 36 FIG. 002 such as Google glasses which could provide GPS screen view, or use of the wireless remote control 61 FIG. 026, which makes available the light and vibration alert signals additionally or instead of sound signals. For operation with such external optional device\feature the apparatus 01 has to have the built-in 2.4 GHz short range optional additional transceiver like a Bluetooth. This feature is not critically important and it is an additional feature for the present invention.

Operation of the solar cells epaulet holder (shoulder strap) and battery charging system 69 FIG. 019.

After attaching the apparatus 01 to the epaulet holder and battery charging system 69 to the user's jacket, both units 01 and 69 do not require the user's attention. The user can detach and attach the apparatus 01 to the Solar cells epaulet holder and battery charging system 69 for using any modes and features at any time as he needs them FIG. 016. FIG. 017, FIG. 018.

Operation with optional additional wireless remote control 61 FIG. 026.

Figure 22:
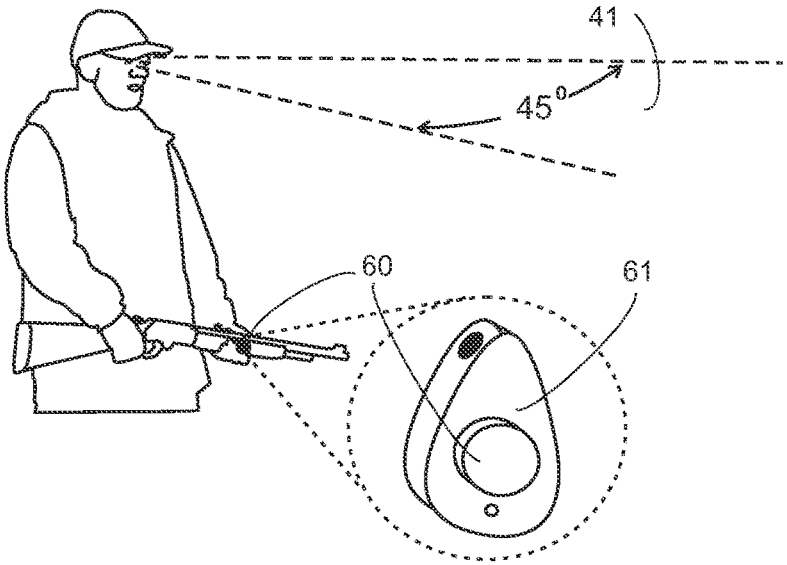
FIG. 022 Depicts the method and procedure of checking the zone of shooting by the hunter who uses the Wireless Remote Control, without turning the weapon towards the target.
Figure 23:
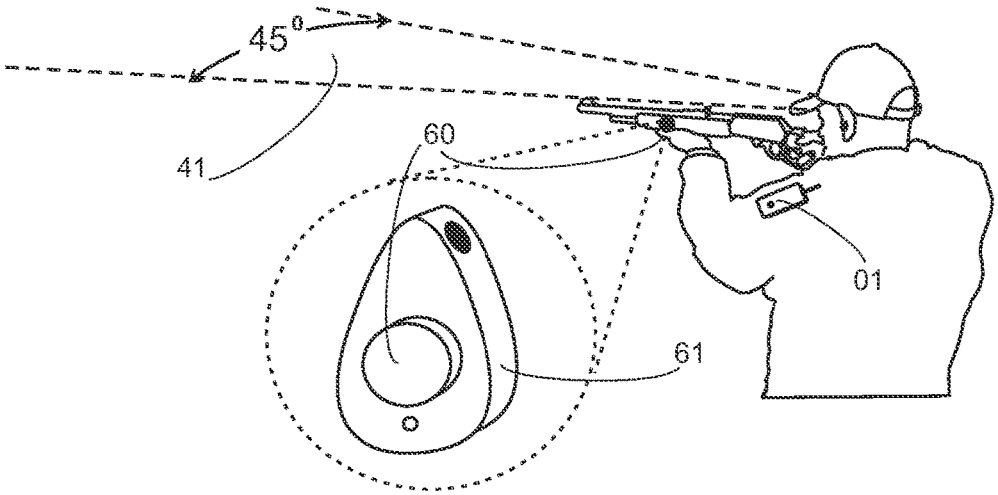
FIG. 023 Depicts the hunter checking the zone of shooting using the Wireless Remote Control during weapon targeting.

Before operation the user must switch apparatus' 01 power switch 07 FIG. 001 and wireless control's power switch 07 FIG. 026 to the ON position and test communication between devices by pressing test button 63 FIG. 026 and ensure that communication between two devices is established. Prior to shooting the shooter checks the zone of shooting for the presence of human beings or other subjects protected by the apparatus 01 or other similar systems. A shooter must turn his body as depicts on FIG. 022 toward the zone of shooting and push the Activation Button 60 FIG. 022 FIG. 24. If the system does not produce (activate) any alert signals and remains silent, the decision, to shot or not to shoot is at the shooter's discretion. However, if any alert signals become activated the user knows that he has to be careful because shooting is unsafe. In comparison with operation in automatic mode without external wireless remote, the shooter forces the activation by pressing the activation button 60 FIG. 027. Using the external Wireless Remote control 61 FIG. 022 FIG. 023 FIG. 024 allows the shooter to use the alert on unsafe shooting mode without the sound signal, which in some cases would be necessary. In this case the shooter has the ability to receive an optional switchable sound signal by speaker 06 FIG. 001, or light 59 FIG. 025 and FIG. 026 by light beam 67 FIG. 027 and/or vibration 58 signals FIG. 025, FIG. 026, FIG. 027.

The wireless remote unit 61 FIG. 026 is equipped with the testing button 63 FIG. 026, which can be pushed anytime. The purpose is to ensure that there is a stable wireless communication between the apparatus 01 and the wireless remote control 61 FIG. 026 As a positive test result the system units' alert signals are activated.

Further on FIG. 024 is depicted the apparatus 01 activation by the wireless activation button 60 of the Wireless Remote Control 61. By this action a short (1 m range) radio transceiver like a Bluetooth 57 emits the radio signal, which activates the apparatus 01 request if the shooting is not safe. In this case the wireless remote control is working instead of accelerometer with gravity and gyroscope sensors 23 FIG. 012.

Further on FIG. 025 it is depicted that after the short (1 m range) service radio transceiver (Bluetooth) 57 receives the response signal from the apparatus 01 it activates the alert Light Signal 59 and vibration signal 58 located on the Wireless Remote Control 61, which means that shooting is not safe.

Left and right handed people can mount the Wireless Remote control 61 FIG. 026 to the left or right side of a weapon using the optional mounting belt/strap fastener 62 FIG. 026. For this the user has to simply take out the mirror cap 64 FIG. 027 and place it into the opening/hood for the Light Signal 65 from the other side of the remote control 61 FIG. 027 and then to attach the remote control 61 FIG. 026 to a weapon to the side and location where it will be convenient to press the activation button 60 FIG. 027 by a thumb and see the light signal 67 FIG. 027 in the opening/hood 65 FIG. 027.

The present detailed description does not show or explain the electrical schemes. Schematic diagrams FIG. 011, FIG. 012, FIG. 013, FIG. 014 show the power lines (full lines) and lines of signals containing information (dotted lines) intended for processing and communication between apparatuses, optional units, similar devices, remote etc. All diagrams are intended for explanatory purpose only, for understanding of the process of the apparatus and supporting units work and operation in alerting on unsafe for shooting mode 10. It is obvious that the detailed explanation of other features doesn't make sense because this technology is well known and tested with modern smart cell phones, GPS units, photo and video products, etc. The proposed invention idea is to create based on existing and developing modern technology the universal device which will solve the issue with unsafe weapon shooting in the sport of shooting and hunting and to equip its user with all modern electronic tools which are usually appreciated in any outdoor activities. In addition, the idea is to minimize any annoyance of the user's time and attention for services typically required for carrying delicate devices and to make one quality device for professional and consumer use.

It is obvious that the design and engineering can be developed differently. The main tasks are to make the apparatus as small and light as possible, with reasonable size of the monitor 09 FIG. 001 for convenient viewing of image in GPS 11 FIG. 002, FIG. 016 and video 14 and photo 15 modes, equipped with optical zoom capable for photography of nature, battery which can provide the apparatus operations for over 24 hours in safe and beaconing modes without additional recharging by the external power supply or by solar cell epaulet 55 FIG. 019. It is obvious that the apparatus and additional units must be equipped with the power battery consumption indicator that allows monitoring the power condition of the units.

Materials

All materials and components required for the present invention manufacturing exist in the market, are well-tested and have long time experience of practical use. Mostly they are related to the manufacturing of the modern smart cell phones and digital photo and video camcorders.

The housing of the apparatus and all external parts is intended for outdoor operating. The housing has to be made from a durable plastic, strong enough for withstanding potential damage if the apparatus is accidentally hit during the user's activity, impacted with a tree or dropped on the ground. The materials for manufacturing of this product have to be chosen considering outdoor conditions.

A proper choosing of the radio frequency is important. It is obvious that for the operation in the forest and on the highway the technical requirements are different. In the U-Minder case (apparatus) the RF communication between units will be affected by leaves, bushes, grass and weather conditions. It is important to find the balance between the power of RF transceivers, range and duration of operation, which affect the battery capacity and its size for the purpose to make the apparatus small and light, otherwise it will be inconvenient for user. In this case it is very helpful the existing long time experience of the development of the walkie-talkie technology and creation and exploitation of the walkie-talkie devices. In the V-Minder case the weight of the equipment and its dimensions are not critically important.

However, the speed of operation is more important due to the vehicles' quick changing of their coordinates. The experience of CB Radio, which is most frequently used by long-haul truck drivers for everything from exchanging information regarding road conditions, locations of speed traps etc. or experience of use of the first responder's vehicles radio communication equipment is very useful for the V-Minder design. So, the existence of both, walkie-talkie and CB radio allows guaranteeing the technical success of the present invention.

Mounting

The solar cells epaulet holder and battery charging system 69 FIG. 020 must be mounted on the top of the shooter's shoulder over their clothes and cannot be covered by anything obstructing the passage of light because the solar cells will not work properly. The user can use a backpack straps or a rifle belt, which cover the solar cells only partly. This issue has to be taken into account for the proper calculation of the total solar cells size and design.

The epaulet apparatus holder and battery solar charging system with supporting equipment unit (system) 69 FIG. 019 must be designed as compatible for both left and right shoulders of the user because the apparatus usage depends on the user's leading hand. The apparatus 01 equipped or not equipped with the solar cells epaulet holder and battery charging system 69 must be attached to the shoulder of the rifle shooter's weak hand or pistol shooter's strong hand. The idea is to attach the apparatus 01 to the user's arm, which rotates the apparatus 01 over 45 degree around the horizontal axis in the process of a gun targeting FIG. 015. Otherwise, the apparatus 01 cannot operate properly in the mode 10 "alert on unsafe shooting" because the accelerometer with gyroscope 23 FIG. 012 cannot not activate this mode 10 FIG. 002 due to insufficient angle of the apparatus rotating around its horizontal axis.

The user can use the optional wireless remote control 61 FIG. 026 and force the request for checking if the shooting is safe. However, in this case the apparatus 01 also must be attached to the shooter's body according to the instructions above because the apparatus 01 must be properly directed and adjusted accordingly with the weapon directing and targeting.

The solar cells epaulet holder and battery charging system 69 FIG. 019 can be mounted to the shooter's jacket in any way, which is convenient for the users. Velcro, stitching or any other technique can be used. A special adjustable universal size harness (not shown) can be designed. All of these options have to follow the main requirements, the proper positioning of the apparatus described above.

Taking into the account that the total weight of the entire system including the apparatus 01 and the solar cells epaulet holder and battery charging system 69 FIG. 019 cannot significantly exceed the weight of the modern smart cell phone, the device location and method of its operations will not cause the user any inconvenience during the apparatus operation.

The apparatus 01 is enclosed into the external device's enclosure/holder 47 with the monitor 09 turned to inside for its protection from potential mechanical damage FIG. 019, FIG. 020, FIG. 021. In this closed and locked position the apparatus 01 is protected from water/dirt in case of rain or a storm.

All mounting mechanism and locks of the holder/enclosure 47 and apparatus 01 FIG. 019, FIG. 020, FIG. 021 are strong and protective enough not to allow losing the apparatus 01 accidently by touching or shaking it if the user is moving or running.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A method of alerting a first user about unsafe shooting in hunting using an electronic device, the method comprising steps of:

a) equipping of other users with other electronic devices, which define the coordinates of each other user and broadcast the other users' coordinates as beacon radio signals during the other users' change of location;

b) mounting said electronic device to the first user's body, which allows rotation of said electronic device around said electronic device's vertical axis only along with the first user's body;

c) defining of the first user's geographical coordinates, d) around the first user's geographical coordinates defining a virtual circle with a preset radius, which lies horizontally on a virtual ground and is virtually fixed to the first user's geographical coordinates and which serves as an operational range, e) locating any other users' coordinates inside and around said virtual circle;

f) defining in said virtual circle a virtual sector with a preset degree angle between two radii, g) fixing and synchronizing said virtual sector with the body of the first user as the point of connection of the two radii of said virtual sector wherein the arc of said virtual sector is directed from said virtual circle's center towards a direction of shooting;

h) rotating said virtual sector around the first user's geographical coordinates inside of said virtual circle along with the first user's body movements;

i) determining said virtual sector as a zone of shooting, j) requesting automatically information on the coordinate points of the other users, or k) alternatively requesting manually information on the coordinate points of the other users; and l) alerting the first user about the presence of the other users in the zone of shooting by an alert signal immediately following the automatic or manual request.

2. The method of claim 1, further comprising steps of:

a) fixing and synchronizing said electronic device with the first user's upper arm; and b) activating the alerting method of said electronic device automatically by the first user's arm moving into a weapon targeting position causing said device to tilt over a preset angle.

3. A universal assisting electronic device with automatic alert safety feature for outdoor activities including hunting comprising:

a) a rechargeable battery and an on/off switch wherein electrical power activates the following components:

b) a GPS receiver, which determines the coordinates of said device, c) processing electronics and firmware, which determine a circle with a preset radius around the coordinates of said device, wherein said circle serves as an operating range for the alert safety feature;

d) an accelerometer or magnetometer, which, by said processing electronics and firmware, keeps said circle in a still position independently from rotation of said device around said device's vertical axis;

e) said processing electronics and firmware, which further determine a sector in said circle with a preset angle between two radii and keeps said sector synchronized with motions of said device around said device's vertical axis and said sector of said circle serves as a zone of shooting;

f) a radio transceiver of a chosen RF, which receives the coordinates of all other similar devices in an area and broadcasts said device's own coordinates as a beacon radio signal;

g) said processing electronics and firmware, which further process received coordinates of the other similar devices relative to said device for the purpose of determining if any of the other similar devices are located inside of the zone of shooting;

h) an accelerometer, gyroscope, or gravity sensor, by which said device tilting around said device's horizontal axis over a preset tilt angle activates a request for information whether any of the other similar devices are located inside of the zone of shooting;

i) a speaker, which produces a sound alert signal if any of the other similar devices are located in the zone of shooting at the moment of the request;

j) a display or command monitor, which allows viewing a GPS map and the coordinates of the other similar devices located relative to said device;

k) a touch screen, which allows switching on/off of other optional functions of said device;

l) a first short range service radio transceiver intended for use with an external wirelessly connected unit;

m) a body or housing of said device, which holds an electronics circuit comprising: the GPS receiver, the accelerometer or magnetometer, the processing electronics and firmware, the radio transceiver of a chosen RF, the accelerometer, gyroscope, or gravity sensor, said first short range service radio transceiver, the speaker, the display or command monitor with the touch screen, the rechargeable battery, and service switches.

4. The device of claim 3, wherein said device is mounted to a user's body for automatic activation of a function of said device and simultaneously charging the rechargeable battery of said device, comprising:

a) a solar cells panel hanged or fixed to the user's shoulder using the upper part of the user's shoulder of a non-dominant arm of the user as a place for said solar cells panel location;

b) the device hanged on said solar cells panel by a top part of said device using a hinge joint;

c) a bottom part of said device connected and fixed to the upper arm of the user, which allows tilting said device only around said device's horizontal axis along with the user's arm, and does not allow rotation of said device around said device's vertical axis; and d) said solar cells panel connected with the rechargeable battery of said device electrically for charging of the rechargeable battery.

5. The device of claim 3, wherein said external wirelessly connected unit comprise:

a) a body or housing, which is equipped with a mounting fixture which allows attaching said external wirelessly connected unit to a hunting gun or a hunter's clothing and holds an electronic circuit with preinstalled firmware comprising: a second short range service radio transceiver, a light source, a press button with a built-in switch and vibrator, a second electrical battery, an on/off switch which activates components with electrical power from said second battery;

b) by pressing said press button with the built-in switch and vibrator, said button activates said second short range service radio transceiver, which transmits a preset requesting radio signal to said first short range service radio transceiver; and c) said second short range service radio transceiver waits for a response signal, and in the case a preset response signal comes back from said first short range service radio transceiver, the preset response signal activates the light source and the vibrator built-in in said press button.

6. The device of claim 5, wherein a light alert signal is applied using said external wirelessly connected unit from both left and right sides, comprising:

a) the light source being placed in an opening, which serves as a hood for the light source and which allows seeing said light source only from a preset angle of view using a preset angle of a mirror fixed to a bung cap installed in said opening on a side of said external wirelessly connected unit, and b) said light alert signal being turned in the opposite direction by removing said bung cap with said mirror fixed to said bung cap and placing said bung cap with said mirror fixed to said bung cap into said opening at the opposite side of said external wirelessly connected unit.

* * * * *